US010786001B2

(12) United States Patent
Prog et al.

(10) Patent No.: US 10,786,001 B2
(45) Date of Patent: Sep. 29, 2020

(54) FILTERED SMOKING

(71) Applicant: Smask, LLC, Brooklyn, NY (US)

(72) Inventors: Leonid Prog, Brooklyn, NY (US); Dillon Galynsky, Brooklyn, NY (US)

( * ) Notice: Subject to any disclaimer, the term of this patent is extended or adjusted under 35 U.S.C. 154(b) by 315 days.

(21) Appl. No.: 15/800,455

(22) Filed: Nov. 1, 2017

(65) Prior Publication Data

US 2018/0116276 A1 May 3, 2018

Related U.S. Application Data

(60) Provisional application No. 62/417,232, filed on Nov. 3, 2016.

(51) Int. Cl.
*A24F 13/22* (2006.01)
*A24D 3/04* (2006.01)
*A24F 13/06* (2006.01)

(52) U.S. Cl.
CPC ..... *A24D 3/04* (2013.01); *A24F 13/06* (2013.01); *A24F 13/22* (2013.01)

(58) Field of Classification Search
CPC ..... A24F 13/02; A24F 13/04; A24F 13/06; A24F 13/14; A24F 13/22; A24D 3/04
USPC ..... 131/187
See application file for complete search history.

(56) References Cited

U.S. PATENT DOCUMENTS 3,695,275 A * 10/1972 Hayward ..... A24F 13/04 131/271
4,790,332 A * 12/1988 Wallace ..... A24F 13/00 131/175
4,807,646 A * 2/1989 Sahar ..... A24F 13/00 131/175
4,899,766 A * 2/1990 Ross, Jr. ..... A24F 13/00 131/175
5,160,518 A * 11/1992 Vega, Jr. ..... A24F 13/00 131/200
5,388,595 A * 2/1995 Shafer ..... A24F 13/00 131/175
5,396,907 A * 3/1995 Rojas Henao ..... A24F 13/00 131/175
5,469,870 A * 11/1995 Meador ..... A24F 13/00 131/187
5,495,859 A * 3/1996 Bowen ..... A24F 13/00 131/202
5,501,234 A * 3/1996 Hyre ..... A24F 13/00 131/187
5,529,078 A * 6/1996 Rehder ..... A24F 13/00 131/175

(Continued)

*Primary Examiner* — Michael H. Wilson
*Assistant Examiner* — Yana B Krinker
(74) *Attorney, Agent, or Firm* — Siddhartha Kamisetti, Esq.

(57) ABSTRACT

The subject disclosure relates to systems, methods, and apparatuses for filtering smoke from a cigarette or other combustible item. In an aspect, the subject disclosure includes employing an inhale chamber comprising a first front portion, a first body portion, and a first rear portion, wherein a cigarette holder element affixed to a rear housing mouth cover of the first rear portion and located within a first hollow cavity portion of the first body portion, and wherein a first valve capable of sealing or unsealing an opening within a first hollow tube portion is located within a second hollow cavity portion of the first rear portion and within the first hollow tube portion that connects the first hollow cavity portion to the second hollow cavity portion.

19 Claims, 14 Drawing Sheets

(56) References Cited

U.S. PATENT DOCUMENTS 5,598,853 A * 2/1997 Hyre ..... A24F 13/00 131/175
6,006,757 A * 12/1999 Lichtenberg ..... A24F 13/00 131/187
6,012,459 A * 1/2000 Keefe ..... A24F 13/00 131/185
6,158,530 A * 12/2000 Bowen ..... A24F 13/00 131/175
6,431,176 B1 * 8/2002 Rice ..... A24F 13/00 131/175
7,861,726 B1 * 1/2011 Lukasavitz ..... A24F 19/0042 131/175
10,405,576 B1 * 9/2019 Adams ..... A24D 3/04
2007/0074734 A1 * 4/2007 Braunshteyn ..... A24F 13/00 131/328
2007/0204868 A1 * 9/2007 Bollinger ..... A24F 13/00 131/174
2007/0283971 A1 * 12/2007 Gidding ..... A24F 7/04 131/202
2008/0060664 A1 * 3/2008 Richards ..... A24F 13/00 131/202
2008/0230077 A1 * 9/2008 Martilik ..... A24F 1/02 131/202
2009/0007926 A1 * 1/2009 Gidding ..... A24F 13/00 131/331
2009/0056728 A1 * 3/2009 Baker ..... A24F 13/00 131/191
2011/0073120 A1 * 3/2011 Adamic ..... A24F 1/00 131/328
2011/0240047 A1 * 10/2011 Adamic ..... A24F 13/00 131/328
2013/0180535 A1 * 7/2013 Rooijakkers ..... A24D 3/04 131/331
2013/0233328 A1 * 9/2013 Jang ..... A24F 13/00 131/187
2018/0042299 A1 * 2/2018 Han ..... A24F 13/12

* cited by examiner

FILTERED SMOKING

PRIORITY CLAIM

This application claims priority to U.S. Patent Application No. 62/417,232 filed on Nov. 3, 2016, and entitled, "Method and System for Filtered Smoking". The entirety of the aforementioned application is incorporated by reference herein.

TECHNICAL FIELD

This disclosure generally relates to devices, systems, and methods for filtering smoke.

BACKGROUND

There has long been an unmet need for a means to filter smoke for health reasons and for odor reasons but the state of the art is lacking in many ways. Traditionally, smokers use filtered cigarettes or e-cigarettes to perform filtered smoking, however, such cigarette technologies still permit an undesirable odor and smoke contaminants as well as particles to permeate through the surrounding environment of the smoker. Furthermore, smokers tend to receive less enjoyment from smoking out of devices like e-cigarettes due to the reduction in the amount of nicotine delivered to the user while smoking from such e-cigarettes. Also, the smoking experience with e-cigarettes are less preferred for some users than conventional cigarette smoking in that e-cigarettes utilize warming mechanisms (e.g., heating a coil) for smoking whereas a traditional cigarette is smoked using a combustion-based approach (e.g., using a lighter to light the cigarette cylinder). As such, there is a need for technologies that solve the above mentioned problems with smoking.

SUMMARY

The following presents a summary to provide a basic understanding of one or more embodiments of the invention. This summary is not intended to identify key or critical elements, or delineate any scope of the particular embodiments or any scope of the claims. Its sole purpose is to present concepts in a simplified form as a prelude to the more detailed description that is presented later. In one or more embodiments described herein are systems, devices, apparatuses, and methods that employ components to facilitate filtered smoking.

According to an embodiment, a system is provided that comprises an inhale chamber comprising a first front portion, a first body portion, and a first rear portion, wherein a cigarette holder element affixed to a rear housing mouth cover of the first rear portion and located within a first hollow cavity portion of the first body portion, and wherein a first valve capable of sealing or unsealing an opening within a first hollow tube portion is located within a second hollow cavity portion of the first rear portion and within the first hollow tube portion that connects the first hollow cavity portion to the second hollow cavity portion.

In another aspect, the system comprises an exhale chamber comprising a second front portion, a second body portion, and a second rear portion, wherein the exhale chamber is connected to the inhale chamber through an inter-chamber orifice, wherein the second body portion comprises a first filter element interlocked to a second filter element, and wherein a second valve capable of sealing or unsealing an opening within second hollow tube portion is located within a third hollow cavity of the second rear portion and within the second hollow tube portion that connects the third hollow cavity to a mouthpiece cavity within the rear housing mouth cover, and wherein a fan element is located within the second front portion. Furthermore, the system comprises an ignition element comprising an igniter filament connected to at least one wire, wherein the at least one wire is connected to an electricity source, and wherein a main housing lower tray houses the fan element.

According to another embodiment, a method is provided. The method can comprise facilitating, by a device comprising an inhale chamber and an exhale chamber, a first flow of first smoke to travel from a cigarette holder element to a second hollow cavity portion of the inhale chamber or a first flow of second smoke from a first hollow cavity portion of the inhale chamber into an inter-chamber opening. The method can also comprise facilitating, by the device, a second flow of second smoke from the inter-chamber opening, through a first filter element, through a second filter element, through a fan element and into a vent opening of the exhale chamber.

According to yet another embodiment, a device is disclosed for filtering smoke. In an aspect, the device comprises an inhale chamber that facilitates a first flow of first smoke to travel from a cigarette holder element to a second hollow cavity portion or a first flow of second smoke from a first hollow cavity portion to an inter-chamber opening. In another aspect, the device includes an exhale chamber that facilitates a second flow of second smoke from the inter-chamber opening, through a first filter element, through a second filter element, through a fan element and into an exit opening of the exhale chamber, or wherein the exhale chamber facilitates a first flow of third smoke from a fifth hollow cavity through a second hollow tube portion, through the first filter element, through a second filter element, through a fan element and into the exit opening.

DETAILED DESCRIPTION

The following detailed description is merely illustrative and is not intended to limit embodiments and/or application or uses of embodiments. Furthermore, there is no intention to be bound by any expressed or implied information presented in the preceding Background or Summary sections, or in the Detailed Description section. One or more embodiments are now described with reference to the drawings, wherein like referenced numerals are used to refer to like elements throughout. In the following description, for purposes of explanation, numerous specific details are set forth in order to provide a more thorough understanding of the one or more embodiments. It is evident, however, in various cases, that the one or more embodiments can be practiced without these specific details.

Aspects and advantages of the invention will be set forth in part in the following description, or may be obvious from the description, or may be learned through practice of the invention. Implementations may include one or a combination of any two or more of the aforementioned features. These and other aspects, features, implementations, and advantages, and combinations of them, can be expressed as methods, apparatus, systems, devices, components, computer program products, computer-implemented methods, computer-implemented systems, business methods, and means or steps for performing functions, or combinations of them. Other features, aspects, implementations, and advantages will become apparent from the description, the drawings, and the claims.

Figure 1:
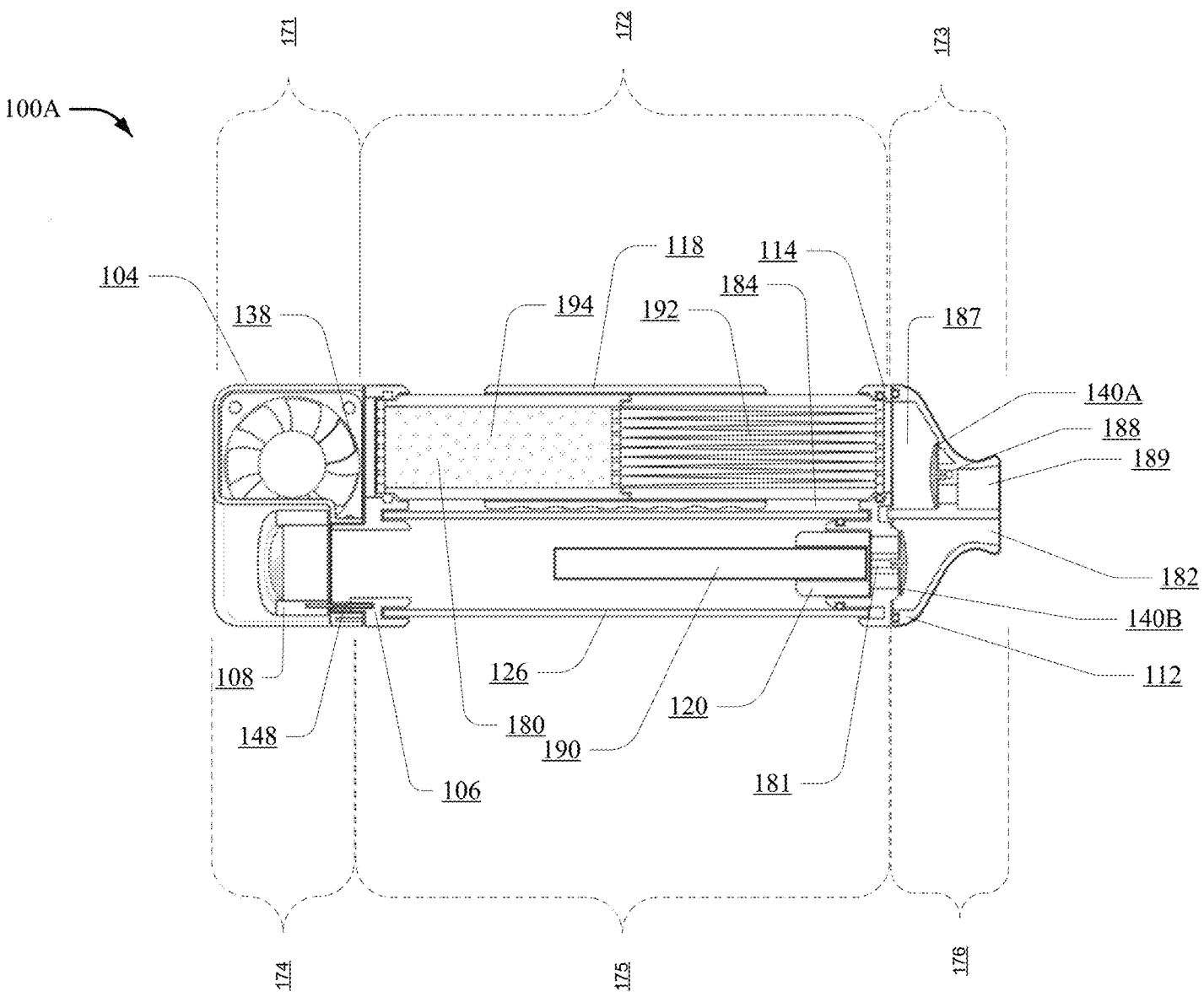
FIG. 1 illustrates a diagram of an example, cross sectional view of a non-limiting smoking system that can facilitate a filtered smoking of a cigarette or other combustible item in accordance with one or more embodiments described herein.

FIG. 1 illustrates a diagram of an example, cross sectional view of a non-limiting smoking system 100A that can facilitate a filtered smoking of a cigarette or other combustible item in accordance with one or more embodiments described herein.

In an aspect, system 100A can comprise main housing lower tray 102 (not shown in FIG. 1), main housing front cover 104, main housing front baffle 106, main housing igniter door 108, main housing electronics cover 110 (not shown in FIG. 1), rear housing mouth cover 112, rear housing inner valve seat 114, in some non-limiting embodiments rear housing knob (over mold) 116 (not shown in FIG. 1), grip 118, cigarette holder element 120 (e.g., comprised of silicone in a non-limiting embodiment), igniter door filter 122 (not shown in FIG. 1), lower housing fan cover 124 (not shown in FIG. 1), smoke tube 126, igniter housing body filter 128 (not shown in FIG. 1), PC board 130 (not shown in FIG. 1), battery 132 (not shown in FIG. 1), ignition element 134 (not shown in FIG. 1), membrane label cover 136 (not shown in FIG. 1), fan element 138, first valve 140A, second valve 140B, first filter O ring 142 (not shown in FIG. 1), smoke tube O ring 144 (not shown in FIG. 1), screws 146 (not shown in FIG. 1), spring element 148 (affixed to igniter door element), pin element 150 (e.g. affixed to igniter door element) (not shown in FIG. 1), inter-chamber orifice 184, cigarette 190, first filter element 192 (e.g., a HEPA filter in a non-limiting embodiment), second filter element 194 (e.g., a charcoal filter in a non-limiting embodiment), first hollow cavity portion 180, first hollow tube portion 181, second hollow tube portion 188, second hollow cavity portion 182, third hollow cavity portion 187, mouthpiece cavity 189, activated carbon 196 (not shown in FIG. 1), and pores 198 (not shown in FIG. 1).

In general, system 100A can comprise a two chamber system employed by a device, with a first chamber (e.g., inhale chamber) dedicated to housing and lighting a cigarette 190 and a second chamber (e.g., exhale chamber) dedicated to filtering an internal flow of side stream smoke (e.g., second smoke) and exhaled smoke (e.g., third smoke) through the system 100A components and into the environment. In an aspect, system 100A can comprise an inhale chamber comprising a first front portion 174, a first body portion 175, and a first rear portion 176, wherein a cigarette holder element 120 is affixed within a first hollow cavity portion 180 of the first body portion, and wherein a first valve (e.g., referring to second valve 140B) located within a second hollow cavity portion 182 of the first rear portion is connected to a first hollow tube portion 181 (e.g., also referred to as a port, terminal or intake port) that connects the first hollow cavity portion 180 to the second hollow cavity portion 182. In an aspect, system 100A employed by a smoke filtering device can facilitate the ignition of a combustible item such as a cigarette and allow the smoke (e.g., first smoke that is inhaled by a smoker) to travel from the first hollow cavity portion 180 to the second hollow cavity portion 182 and into a user mouth for inhalation of the smoke. The first smoke can emanate from an opening in an ignited cigarette 190 (e.g., or other combustible item such as a rolled tobacco or marijuana item) held in place by cigarette holder element 120. In an aspect, the first smoke can represent the first hand smoke (e.g., also referred to as main smoke) a user desires to inhale from a cigarette 190 which contains the nicotine or active ingredients present within cigarette 190. In another aspect, cigarette 190 can be ignited within smoke tube 126 from an ignition element 128 (comprised of an igniter filament and wiring in a non-limiting embodiment) that can be connected to the filtered smoking device and heated to a temperature level sufficient to ignite cigarette 190.

Furthermore, in an aspect, the main housing ignition door 108 can be opened using any variety of opening mechanisms such as a hinge connecting the main housing ignition door 108 to main housing front baffle 106 of the first body portion of the inhale chamber. Furthermore, in an aspect, the ignition element 128 can be inserted within first hollow cavity portion 180 within smoke tube 126 until it contacts cigarette 190. Accordingly, the heat emanating from ignition element 128 can spark a burning of cigarette 190 and its contents (e.g., *cannabis*, synthetic *cannabis*, tobacco, any of a variety of combustible leaf or plant matter, etc.). In another aspect, upon combustion of cigarette 190 or other combustible item, the ignition element 128 can be removed from the smoke tube 126 and main housing ignition door 108 can be closed. In a non-limiting embodiment, the hinge connecting main housing ignition door 108 to main housing front baffle 106 can comprise a spring element 148 and/or a pin element 150 (e.g., to facilitate a spring loading open and close mechanism). In an aspect, pin element 150 can line up with hinges on the shell of main housing front cover 104 and/or main housing igniter door 108. In other non-limiting embodiments, the open and closing mechanism can also include a clipping mechanism, magnetic mechanism, clasping mechanism, screw mechanism and other such open and closing components to facilitate such techniques. In yet another aspect, ignition element 128 can be heated to a temperature sufficient to ignite cigarette 190 based an electrical and/or digital signal from a pressing of a button (e.g., button input) of the membrane label cover for instance.

In yet another aspect, the main housing ignition door element 108 can allow air to intake into smoke tube 126 via an entrance pathway through an igniter door filter 122 and into smoke tube 126. In an aspect, a user can inhale through the rear housing mouth cover 112 resulting in a flow of air moving towards the second hollow cavity portion 182. This flow of air pushes air through the main housing ignition door 108 and through the igniter door filter 122 which can force first smoke from cigarette 190 within smoke tube 126 through the first hollow tube portion 181 and into second hollow cavity portion 182, where it can enter a user mouth for inhalation. Furthermore, in an aspect, the igniter door element 108 allows air to pass into the smoke tube 126, but does not allow first smoke to escape through the igniter door element 108. In an aspect, the igniter door filter 122 acts as a one-way membrane that allows air to pass through it into the smoke tube 126 but acting as a barrier to prevent first smoke from escaping. In another aspect, a user forming a seal around a mouthpiece can inhale through second hollow cavity portion 182 which can both pull air through the main housing ignition door 108 and first smoke within smoke tube 126 towards second hollow cavity portion 182.

In another aspect, the first smoke that enters the second hollow cavity portion 182 does so through an opening in the first hollow tube portion 181 created by an opening (e.g., first opening) from second valve 140B, thus unblocking the first opening in first hollow tube portion 181 proximally located adjacent to the second hollow cavity portion 182. In an aspect, second valve 140B creates a seal with the opening (e.g., second opening) in first hollow tube portion 181 that opens into the second hollow cavity portion 182. The second opening of first hollow tube portion 181 opens into the first hollow cavity portion 180 and can abut cigarette 190. In an aspect, the second valve 140B is configured to release its seal with the first opening upon a pull force from a user inhalation through second hollow cavity portion 182 on an umbrella-like portion of second valve 140B. As such, the pull force can invert an umbrella portion of second valve 140B (e.g., comprised of an umbrella portion and a stem portion capable of wedging within a first hollow tube portion 181) thus allowing the contents (e.g., first smoke and air) within smoke tube 126 to enter second hollow cavity portion 182 and ultimately into a users' lungs.

Accordingly, in an aspect, second valve 140B can serve to both contain first smoke and/or air within smoke tube 126 and/or release first smoke and/or air into second hollow cavity portion 182 based on pressures and/or forces exerted upon such second valve 140B. At resting position (e.g., no forces exerted), second valve 140B acts as a barrier between second hollow cavity portion 182 and first hollow cavity portion 180. In a non-limiting embodiment, second valve 140B can be a mini valve or a mini petal valve. In other embodiments, other valves (e.g., duckbill valve, umbrella valve, combination valve, custom valve, etc.) can be utilized for second valve 140B or first valve 140A. In an aspect, second valve 140B requires a great enough force (e.g., resulting from a pressure differential created by an inhalation force and air flow into the smoke tube 126) to be applied to the umbrella portion to displace the valve enough to allow first smoke to enter the second hollow cavity portion 182. In another aspect, first valve 140A and second valve 140B can be facing in opposite directions to keep both the inhale chamber and the second chamber sealed and prevent leakage (e.g., of smoke and/or air) when system 100A is not in use (e.g., neither an inhale or exhale operation is performed). In an aspect, the first valve 140A and second valve 140B create a seal to contain air and smoke within each respective chamber (e.g., inhale chamber, exhale chamber) and upon an occurrence of a pressure difference (based on a user inhale or exhale), the first valve 140A or second valve 140B can temporarily move thus breaking the seal momentarily and allowing first smoke to exit first hollow cavity portion 180 entering second hollow cavity portion 182 or allow third smoke to enter third hollow cavity portion 187 from mouthpiece cavity 189.

In another aspect, cigarette 190 can also produce second smoke (e.g., burns off the cigarette 190) which emanates from the ignited or lit end of cigarette 190 (e.g., the end closer to main housing igniter door 108). In an aspect, second smoke can be referred to as second-hand smoke which traditionally is released into the environment surrounding a smoker or user and acts as an odor nuisance and bothersome as well as unwanted inhalant to surrounding people. As such, system 100 mitigates both odor, contaminant particles and inhalant problems by capturing second smoke within smoke tube 126, channeling the second smoke into the exhale chamber filter components, and propelling the filtered byproduct of the second smoke out a vented compartment. Thus, the unwanted second smoke emanating from cigarette 190 is neither inhaled by the user nor those people surrounding the user.

Accordingly, system 100A can include an exhale chamber comprising a second front portion 171, a second body portion 172, and a second rear portion 173, wherein the exhale chamber is connected to the inhale chamber through an inter-chamber orifice 184, wherein the second body portion 172 comprises a first filter element 192 interlocked to a second filter element 194, and wherein a second valve (e.g., referring to first valve 140A) located within a third hollow cavity of the second rear portion is connected to a second hollow tube portion that connects the third hollow cavity to a mouthpiece cavity within a mouthpiece housing element, and wherein a fan element 138 is located within the second front portion. In an aspect, the fan element 138 functions to circulate air and smoke from the inhale chamber to the exhale chamber via inter-chamber orifice 184 (e.g., a gap in the shell between inhale chamber and exhale chamber). In a non-limiting embodiment, the exhale chamber can comprise a first filter 192 which can be a HEPA filter and a second filter 194 which can be a charcoal filter. In an aspect, an ultraviolet light filter (e.g., a filter that emits ultraviolet rays) can be employed within any one or more cavity of system 100 (e.g., third hollow cavity 187).

In a non-limiting embodiment, the first filter 192 and the second filter 194 can interconnect via a snapping mechanism. In other non-limiting embodiments, the first filter 192 and second filter 194 can interlock in any of a variety of mechanisms including a snapping mechanism, magnetic interlocking mechanism, clip mechanism, latching mechanism, and other such interlocking or integration mechanisms. In an aspect, first filter 192 can be a high efficiency particulate air (HEPA) filter that meet HEPA standards set forth by the U.S. Department of Energy (DOE). As such, the filter can serve to remove a significant level of particles from the second smoke and third smoke (e.g., smoke that was previously inhaled by a user, that is exhaled back into the device employing system 100A) that passes through such first filter 192. For instance, a high percentage of particles within second smoke and third smoke having a size of 0.3 micrometers and larger may be removed via first filter 192. In an aspect, the first filter 192 can comprise one or more filter sheets that separate particles from other elements in the smoke that passes through them. In an instance, unwanted particles (e.g., odor particles) within the smoke can be intercepted upon impact with fibers of each filter sheet and the remaining smoke can diffuse through the first filter 192.

In a non-limiting embodiment, second filter 194 can be a charcoal filter comprising activated carbon that can utilize adsorbent properties to further eliminate other unwanted particles (e.g., including odor and impurities). In an aspect, pores within the activated carbon can cause contaminants and unwanted organic compounds to stick to the activated carbon such that the remaining second smoke and/or third smoke passing through the filter can be purified and ultimately exited (e.g., propelled outward) through a fan element 138. In another aspect, the activated carbon (e.g., activated charcoal filter) of second filter 194 can absorb gases and chemicals within the activated carbon pores. In an aspect, first filter 192 and second filter 194 can be replaceable such that the entire cartridge housing a respective filter insert can be replaced when filled with contaminant filtrates or particles. Furthermore, in a non-limiting embodiment, second filter 194 can comprise a canister that holds current activated carbon filter mixture. Furthermore, in an aspect, the canister can include a multi-tiered assortment of activated carbon compressed between fabric sheets and a paper filter. In a non-limiting embodiment, the canister can slip in and out of a housing of second filter 194 based on a pressure hold or in other embodiments based on a locking mechanism to ensure the canister does not dislodge based on a dropping or impact to the device employing system 100A. In another non-limiting embodiment, first filter 192 can also include a canister that can be changed based on a need for replacement.

In a non-limiting embodiment, the second smoke can enter the first filter 192 via an inter-chamber orifice 184. In an aspect, the inter-chamber orifice 184 can be replaceable and can insert and/or plug into first filter 192 (e.g., into an opening in first filter 192). In another aspect, the inter-chamber orifice 184 can comprise various size properties that allow for the control of second smoke from entering into the first filter 192 of the exhale chamber but prevent such second smoke from re-entering the smoke tube 126 of the inhale chamber. In an aspect, the inter-chamber orifice 184 can comprise an entrance hole on the inhale chamber side of inter-chamber orifice 184 and an exit hole on the exhale chamber side of the inter-chamber orifice 184 that allows second smoke to travel from smoke tube 126 into first filter 192. In another aspect, the entrance hole can be larger than the exit hole such that the entrance hole resembles a wider mouth that funnels into a narrower exit hole. Accordingly, the second smoke can find its way into first filter 192 through the entrance hole and out the exit hole but cannot re-enter the narrow exit hole.

Furthermore, in an aspect, the fan element 138 can pull the second smoke through the first filter 192 and second filter 194 towards the fan element 138, which also inhibits the second smoke from re-entering through the narrower exit hole of inter-chamber orifice 184. In another aspect, a force from a user exhale into mouthpiece cavity 189 can be exerted on second smoke within first filter 192 to push the second smoke through first filter 192, second filter 194, and toward fan element 138. Accordingly, in another aspect, both the pull force from fan element 192 and the push force from the exhalation into mouthpiece cavity 189 can cause second smoke (e.g., side stream smoke from a cigarette 190) within first filter 192 to push through an exit opening of system 100A rather than re-enter into the narrower exit hole of inter-chamber orifice 184.

In another non-limiting embodiment, mouthpiece cavity 189 can be a hollow cavity configured to allow a user to exhale mainstream smoke also referred to as third smoke (e.g., smoke that is inhaled and then exhaled from a smoker's lungs) into system 100A. In an aspect, the force from an exhalation of third smoke into the mouthpiece cavity 189 can facilitate the third smoke to travel within second hollow tube portion 188 and push open a seal created by first valve 140A and an opening at the end of second hollow tube portion 188. In an aspect, first valve 140A seals an opening between second hollow tube portion 188 and third hollow cavity portion 187. In an aspect, the force from the exhalation (e.g., resulting in a pressure differential that forces open the first valve 140A) of third smoke pushes on the underside of the umbrella portion of first valve 140A thus dislodging the underside surface of first valve 140A from the seal created with second hollow tube portion 188. Accordingly, in an aspect, the third smoke enters hollow cavity portion 187 and upon the seizing of the applied exhalation force to the underside of first valve 140A, the first valve 140A returns to its resting position which seals the opening between second hollow tube portion 188 and third hollow cavity portion 187.

Furthermore, in an aspect, the third smoke can travel through first filter 192 and second filter 194 in order to purify the third smoke of particles and other contaminants prior to exiting system 100A via fan element 138 and through a venting element (not shown in FIG. 1). Also, the force exerted from the exhalation of a user and from the pull force of fan element 138 can facilitate a movement of third smoke through the first filter 192 and second filter 194 and into fan element 138. As such, second smoke and third smoke can be purified and removed of contaminant particles such as odor particles prior to being circulated into the surrounding environment.

In another aspect, system 100A can include an ignition element 128 (also referred to as igniter housing body element 128) (not shown in FIG. 1) comprising an igniter filament connected to at least one wire 134, wherein the ignition element 128 is affixed to a main housing lower tray 102 (not shown in FIG. 1) that supports a lower portion of the inhale chamber and the fan element 138. In an aspect, one side of the ignition element 128 is connected to the wire portion (e.g., first wire connection portion) of the igniter filament connected to at least one wire 134. In an aspect, the first wire connection portion connected to the ignition element 128 controls an amount of electricity that can travel through and into the ignition element 128 in order to heat up an end of ignition element 128 that is distal from the first wire connection portion. In another aspect, the wire portion (e.g., second wire connection portion) that is connected to the main housing lower tray 102 and PC board 130 can source electrical power from a battery 132 connected to such PC board 130. In an aspect, battery 132 can be any of a variety of battery types and in a non-limiting embodiment battery 132 can be a lithium polymer 12-volt battery. In another aspect, the wire portion of igniter filament connected to at least one wire 134 can be comprised of a nickel chrome material also referred to as nichrome (e.g., any variant of alloys of nickel, chromium and/or iron) that is resistant to heat such that it protects heating elements of system 100A from oxidation and allows the end of the ignition element 128 to heat up when a high temperature electric current is sent through such wire portion. Furthermore, in an aspect, the PC board 130 and battery 132 facilitate the flow of electricity to components such as fan element 138 and in a non-limiting embodiment a heat sensor (e.g., capable of detecting heat or temperatures) within the inhale tube, can be capable of tracking a position of the cigarette ember. Accordingly, system 100A can notify a user how much of a cigarette has been smoked as displayed on a user interface (e.g., an LED panel or membrane label cover 136).

In another aspect, ignition element 128 can rest within a recess groove on a main housing lower tray 102. For instance, the ignition element 128 can externally clip or snap onto the recess groove on the main housing lower tray 102. In an aspect, the ignition element 128 can resemble a stick which is capable of insertion into an opening created by an ajar main housing igniter door 108. The end of the ignition element 128 that is distal to the wire portion can make contact with a cigarette 190 within smoke tube 126 and the heat from such distal portion can cause the cigarette 190 to ignite and the contents to combust thus creating second smoke emanating from cigarette 190 and allowing for first smoke to be drawn through the tube of cigarette 190. In an aspect, ignition element 128 can reach deep or shallow portions of the smoke tube 126 in order to allow for the igniting of various sizes of cigarette 190.

In another aspect, the main housing igniter door 108 is capable of opening and closing. In an aspect, an open housing igniter door 108 allows for the insertion of cigarette 190 into smoke tube 126 or removal of a cigarette 190 or cigarette 190 remains (e.g., cigarette butt). In yet another aspect, a closed main housing igniter door 108 allows for the capture of second smoke within the inhale chamber (e.g., smoke tube 126) and does not let such odorous and contaminant containing second smoke exit the inhale chamber. In another aspect, the main housing igniter door 108 comprises an igniter door filter 122 that doesn't allow smoke to leave the inhale chamber but allows air to be sucked into the smoke tube 126 from outside the main housing igniter door 108. The cigarette can be ignited using the oxygen sucked into the smoke tube 126 and the intake air can also be filtered by igniter door filter 122 (e.g., a mesh membrane that blocks off smoke particles from exiting but allows oxygen into smoke tube 126).

In another aspect, main housing lower tray 102 can support one or more components of system 100 including, but not limited to a PC board 130, battery 132, lower housing fan cover 124 (e.g., not illustrated in FIG. 1) fan element 138, and a main housing front baffle 106 (not illustrated in FIG. 1). In an aspect, main housing lower tray 102 can serve as a lower casing for a device that employs system 100, such as a smoking device. In another aspect, igniter housing body 128 can clip, snap, or connect to the lower housing fan cover 124 (not shown in FIG. 1) in one or more manner. In a non-limiting embodiment, lower housing fan cover 124 can be a metal mesh screen or an activated carbon mesh screen. In yet another aspect, a membrane label cover 136 can be affixed to an outer surface of main housing lower tray 102 in order to act as a user interface. For instance, membrane label cover can include buttons that allow the user to execute (e.g., using a processor such as PC board 130) several operations such as heating igniter housing body 128, turning on or off fan element 138, displaying information related to system 100A components (e.g., indicator light that components are running or powered off, indicator lights that indicate whether a filter is filled to capacity with contaminants and requires changing, indicator light that indicates an igniter housing body 128 is heating up or is at optimal heat level for lighting cigarette 190, etc.), and an indicator light that indicates a first valve 140A and/or second valve 140B (e.g., a petal valve) needs to be cleaned and/or replaced.

In another aspect, fan element 138 can be any of a variety of fans that propel air based on the turning of propellers. Furthermore, in a non-limiting embodiment, fan element 138 can be facing towards vented openings in the lower housing fan cover 124 such that filtered second smoke and filtered third smoke can exit through the vent openings in the lower housing fan cover 124. In an aspect, such configuration (venting filtered smoke through vents located at a bottom surface of main housing lower tray 102) can facilitate the flow of smoke out of system 100A such that the filtered smoke will advance into the surrounding environment outside of system 100A and prevent a recycling of smoke back into system 100A. In another non-limiting embodiment, fan element 138 can be configured to stand upright, perpendicular to the vented openings. In yet another non-limiting embodiment, the vented openings can be located in other regions of system 100A to allow for the filtered smoke to enter the surrounding environment via different exit openings. In another non-limiting embodiment system 100A can be operatively coupled to a processor that executes computer executable components stored in memory. In an aspect, the processor can cause the components of system 100 to perform operations such as turning on fan element 138, heating an ignition element 128, causing electricity to be delivered to various system 100A components and other such operations. Furthermore, in an aspect, system 100A can generate, transmit, and/or store data representing information associated with system 100A activities.

For instance, the processor can execute system components that allow for the tracking of data representing a number of cigarette 190 consumed over a period of time, quantity of contaminants and/or particles removed using first filter 192 and second filter 194 individually or collectively, battery power level, level of THC detected (e.g., using sensors) within a unit of *cannabis* (e.g., present within cigarette 190), nicotine level consumed or within the atmosphere surrounding system 100A (or a device employing system 100A), average temperature required of ignition element 128 during each smoke session, average unit of nicotine or other ingredient (e.g., tar, THC, etc.) inhaled during a target period of time, recommendations for cleaning particular components (e.g., filter, orifice, mouthpiece, etc.), usage or consumption-based data (e.g., how many cigarette 190 a user smokes in a given time, the quantity of active ingredient captured within a user lungs, etc.) and other such information associated with operations performed by components of system 100.

Figure 2:
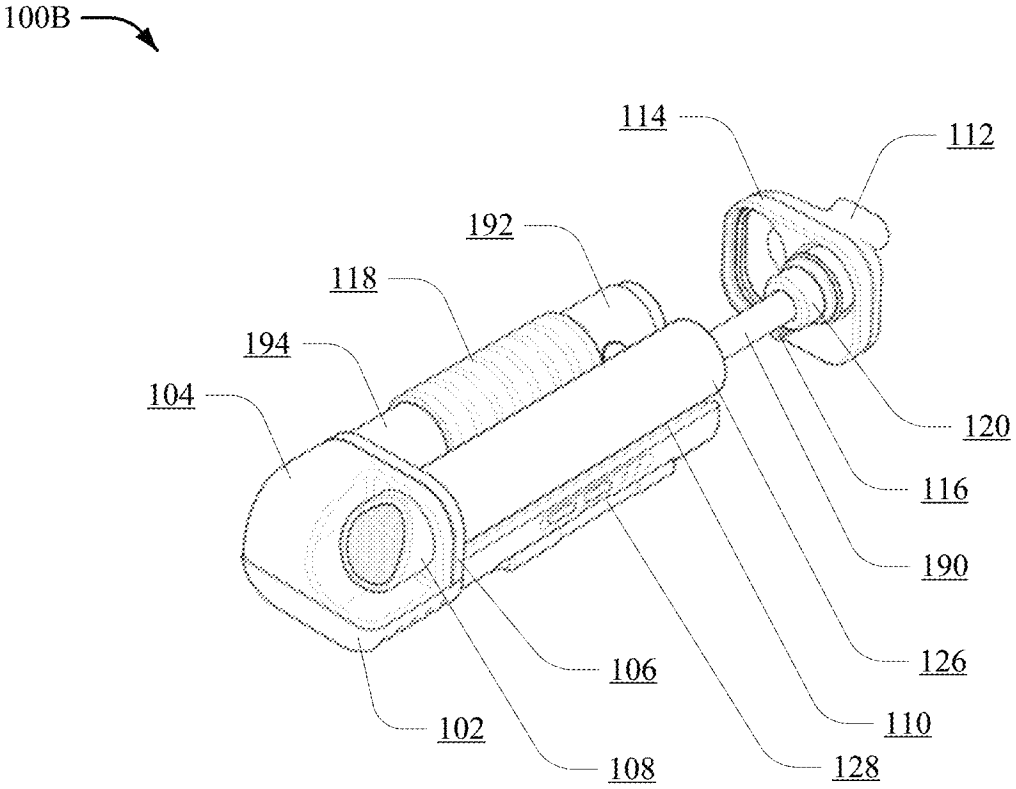
FIG. 2 illustrates a diagram of an example, exploded view of a non-limiting system that can facilitate a filtered smoking of a cigarette or other combustible item in accordance with one or more embodiments described herein.

Turning now to FIG. 2, illustrated is a diagram of an example, exploded view of a non-limiting system 100B that can facilitate a filtered smoking of a cigarette or other combustible item in accordance with one or more embodiments described herein. Repetitive description of like elements employed in other embodiments described herein is omitted for sake of brevity. In an aspect, system 100B includes all of the elements of system 100A illustrated in FIG. 1, however the illustration captures several components from an aerial exploded viewpoint as opposed to the cross-sectional view illustrated in system 100A of FIG. 1.

In an aspect, system 100B can comprise all of the elements of system 100A, however system 100B provides a view of main housing lower tray 102, main housing front cover 104, main housing front baffle 106, main housing igniter door 108, main housing electronics cover 110, rear housing mouth cover 112, rear housing inner valve seat 114, rear housing knob (over mold) 116, grip 118, cigarette holder element 120 (e.g., comprised of silicone in a non-limiting embodiment), smoke tube 126, igniter housing body filter 128, first filter 192, cigarette 190, and second filter 194. In another aspect, main housing lower tray 102 encases the lower portion of system 100B.

Accordingly, in an aspect, more system 100A components are viewable in FIG. 2 due to the perspective vantage point including, but not limited to, main housing lower tray 102 which can contain PC board 130 and/or battery 132. In an aspect, system 100B illustrates system 100A components employed within a device from which a user can inhale and exhale smoke. In an aspect, main housing front cover 104 can interlock with a front portion of main housing lower tray 102. In a non-limiting embodiment, main housing front cover 104 can be configured with an opening on the inhale chamber side such that a main housing igniter door 108 can be hinged onto the main housing front cover 104 to cover the opening. In a non-limiting instance, the main housing igniter door 108 can be hinged onto the main housing front cover 104 using a pin 150 and/or spring 148 mechanism. In other embodiments, the main housing igniter door 108 can be connected to the main housing front cover 104 using any of a range of connection mechanisms that allow the main housing igniter door 108 to swing open and closed.

In another aspect, igniter door filter 122 can sit between the main housing igniter door 108 and the main housing front cover 104 to facilitate covering the opening in such main housing front cover 104. In another aspect, second filter 194 can connect to a side of the main housing front cover 104 that is walled off (e.g., doesn't comprise an opening). In between the main housing front cover 104 and the second filter 194 can rest a main housing front baffle 106 configured to facilitate a snug integration of second filter 194 into the main housing front cover 104. Furthermore, in an aspect, system 100B illustrates grip 118 configured to allow a user to grasp an outer housing of a first filter 192 and/or second filter 194 of a device employing system 100B with a stable and low friction grasp. In another aspect, grip 118 can fit over first filter 192 and second filter 194 acting as an additional component to hold both filters together (e.g., in addition to the interlocking mechanism that holds them together). Furthermore, in an aspect, grip 118 can be configured to retrofit a first filter 192 and/or second filter 194 and allow for an ergonomic grip around each respective filter. In a non-limiting embodiment, grip 118 can insulate each respective filter from conducting too much heat which would allow a user to comfortably hold a device employing system 100B at grip 118 without being irritated or harmed by extreme temperatures.

In an aspect, system 100B also comprises rear housing inner valve seat 114 configured to connect with the inhale chamber at smoke tube 126 and the exhale chamber at first filter 192. In an aspect rear housing inner valve seat 114 is also configured to hold first valve 140A and second valve 140B. In another aspect, a rear housing mouth cover 112 can extend from rear housing inner valve seat 114, wherein such rear housing mouth cover 112 can be configured to facilitate a user mouth engaging with system 100B. In an aspect, rear housing mouth cover 112 can create a flush seal with rear housing inner valve seat 114. In another aspect, a user can access both inhale and exhale chambers using rear housing mouth cover 112 and can perform an inhale operation and exhale operation through rear housing mouth cover 112. In yet another aspect, rear housing inner valve seat 114 can comprise a cigarette holder 120 that can be comprised of silicone material. The cigarette holder 120 can be adjusted to clamp in place a cigarette 190 of a range of sizes and shapes.

Also, in an aspect, cigarette holder 120 can create a tight seal around a butt of cigarette 190 such that the butt of cigarette 190 is walled off from all other smoke and directly interfacing an opening in first hollow tube portion 181 thus allowing a user to inhale only first smoke from cigarette 190. In another aspect, a rear housing knob 116 can be located on rear housing inner valve seat 114 and configured to hold (e.g., screw together) the rear housing inner valve seat 114 together with the main housing lower tray 102, smoke tube 126 and first filter 192. Also, in a non-limiting embodiment, smoke tube 126 can be comprised of any of a variety of glass materials (e.g., black tempered glass, tinted glass, gradient tinted glass such that a user can see into smoke tube 126 to view the progress of cigarette 190 being smoked such as being smoked to completion). Furthermore, in an aspect, rear housing knob 116 can be removed (e.g., unscrewed) to allow access to cigarette holder 120 in order to load, reload, or unload a cigarette 190 or cigarette butt respectively. In some non-limiting embodiments, in lieu of rear housing knob 116 can be a snapping mechanism or clipping mechanism between rear housing inner valve seat 114 and rear housing mouth cover 112. In a non-limiting embodiment, cigarette holder 120 can be configured as a cone that allows a cigarette 190 to be squished within such cone shape an be firmly held within the cone. In another non-limiting embodiment, cigarette holder 120 can be configured as a clamp mechanism that clamps around a cigarette 190 end (e.g., filter).

As such, rear housing knob 116 can hold components and elements of system 100B (and other system embodiments) together as well as allow access to the cigarette holder 120. In another aspect, system 100B can comprise smoke tube 126 and main housing electronics cover 110. In an aspect, main housing electronics cover 110 can act as a lid configured to fit over main housing lower tray 102 in order to conceal the electronics within the cavity of main housing lower tray 102. Also, in a non-limiting embodiment, a cutout in main housing electronics cover can provide access to a micro-USB for charging of system 100B electronic components. In another aspect, igniter housing body 128 can be clipped onto the main housing lower tray 102. In yet another aspect, the rear housing inner valve seat 114 can be configured to form a seal with main housing lower tray 102, first filter 192, and/or smoke tube 126 thus forming a monolithic device that can utilize system 100B for smoking while filtering odors and contaminants from second smoke and third smoke that exits system 100B.

Figure 3:
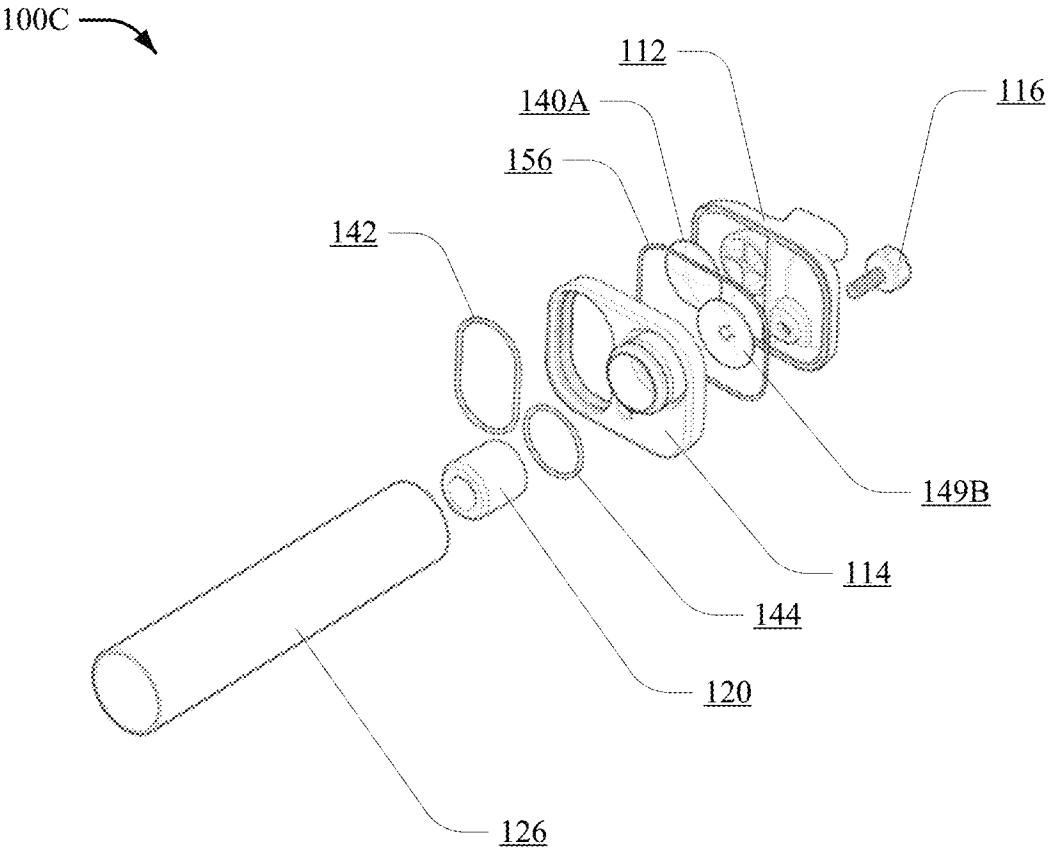
FIG. 3 illustrates a diagram of an example, exploded view of several non-limiting components of a system that can facilitate a filtered smoking of a cigarette or other combustible item in accordance with one or more embodiments described herein.

Turning now to FIG. 3, illustrated is a diagram of an example, exploded view of several non-limiting cleanable components of a system 100C that can facilitate a filtered smoking of a cigarette or other combustible item in accordance with one or more embodiments described herein. Repetitive description of like elements employed in other embodiments described herein is omitted for sake of brevity. In an aspect, all of the components illustrated in system 100C are included and/or part of system 100A and system 100B in an exploded view. In an aspect, some components of system 100A and system 100B are not included in system 100C in order to have an unobstructed view of some of the system components.

In an aspect, system 100C provides a view of some of the components of system 100A and system 100B including, rear housing mouth cover 112, rear housing inner valve seat 114, rear housing knob 116, cigarette holder 120, smoke tube 126, first valve 140A, first filter O ring 142, smoke tube O ring 144, and bypass grommet 156. In another aspect, the hollow cavity of smoke tube 126 can circumscribe cigarette holder 120 as illustrated in FIG. 3. Furthermore, in an aspect, smoke tube 126 can affix to rear housing inner valve seat 114 and between the interface of smoke tube 126 and rear housing inner valve seat 114 can be a smoke tube O ring 144. In an aspect, smoke tube O ring 144 can sit within a groove located on either or both of smoke tube 126 and/or rear housing inner valve seat 114. In an another aspect, smoke tube O ring 144 can create a seal at the interface between both the smoke tube 126 and rear housing inner valve seat 114 thus ensuring that second smoke does not escape from the smoke tube 126. In an aspect, the smoke tube O ring 144 can have other sealing profiles such as a Q-ring, X-ring or other gasket or ring cuts.

Furthermore, in an aspect, first filter O ring 142 can sit within a groove within, on and/or between first filter 192 and rear housing inner valve seat 114 in order to create a seal at the interface between both components. In an another aspect, first filter O ring 142 can create a seal at the interface between both the first filter 192 and rear housing inner valve seat 114 thus ensuring that second smoke and third smoke does not escape from the exhale chamber. In an aspect, the first filter O ring 142 can have other sealing profiles such as a Q-ring, X-ring or other gasket or ring cuts. In yet another aspect, a surface of rear inner valve seat 114 can also interface with bypass grommet 156 to facilitate and/or manage an airflow between first hollow cavity 180 and second hollow cavity portion 182 in connection with second valve 140B. Furthermore, in an aspect, a surface of rear inner valve seat 114 can also interface with bypass grommet 156 to facilitate and/or manage an airflow between mouthpiece cavity 189 and third hollow cavity portion 187. In an aspect, bypass grommet 156 can act as an interface between first valve 140A and rear housing inner valve seat 114. Furthermore, in an aspect, bypass grommet 156 can act as an interface between second valve 140B and rear housing inner valve seat 114. In yet another aspect, bypass grommet 156 can also serve as an interface between rear housing inner valve seat 114 and rear housing mouth cover 112.

In another aspect, FIG. 3 illustrates first valve 140A and second valve 140B configured to interface with second hollow tube portion 188 and first hollow tube portion 181 respectively. Together, first valve 140A and second valve 140B facilitate smoke flow and air flow between chambers based on an opening or closing of respective valves. Furthermore, in an aspect, first valve 140A can be configured to operate as a one-way sealing vale that can satisfy the smoke flow and air flow requirements of system 100A-100C and other system embodiments disclosed herein. In an aspect, first valve 140A can seal an entrance opening in second hollow tube portion 188 and allow for third smoke to travel from mouthpiece cavity 189 to third hollow cavity portion 187 by dislodging the first valve 140A from second hollow tube portion 188.

In an aspect, the bypass grommet can act as a backing against the umbrella head surface of first valve 140A and second valve 140B, thus allowing each respective valve to be dislodged but remain in a position to lodge into a hollow tube opening based on the absence of a dislodging air flow or smoke flow. In yet another aspect, second valve 140B can seal an entrance opening in first hollow tube portion 181 and allow for first smoke to travel from first hollow cavity portion 180 to second hollow cavity portion 182 by dislodging the second valve 140B from first hollow tube portion 181. Furthermore, in an aspect, bypass grommet 156 can again serve as a supporting surface by which the top surface of second valve 140B can push against in order to positioned to lodge within the opening in first hollow tube portion 181 based on a stoppage of a dislodging air flow. In an aspect, the bypass grommet 156 can act as a seat within which the top surface of the umbrella portion of first valve 140A and second valve 140B are seated.

In another aspect, rear housing mouth cover 112 can be configured to facilitate an intake of third smoke (e.g., from a user exhale) or an outflow of first smoke (e.g., from a user inhalation of main smoke from cigarette 190). In an aspect, an outer portion of rear housing mouth cover 112 can comprise a protruding lip configured to receive a user mouth for inhalation and exhalation into system 100A-C. Furthermore, in an aspect, the inner cavity of rear housing mouth cover 112 can comprise a second hollow tube portion 188 for receiving a stem of first valve 140A. In another aspect, rear housing mouth cover 112 can comprise a hole to receive rear housing knob 116 that can bolt the rear housing mouth cover 112 to the other portions of system 100A-C including rear housing inner valve seat 114. In an aspect, rear housing knob 116 can comprise threading that complimentarily fits with ridges within the hole in rear housing knob 116 to allow a secure screw-like or clamp-like tethering of rear housing knob 116 within the hole. In another non-limiting embodiment, system 100A-C can include a mechanism to fasten or click the rear housing mouth cover 112 to rear housing inner valve seat 114 absent a rear housing knob 116. For instance, a click-in mechanism can be used to snap/click together and unsnap/unclick apart the rear housing mouth cover 112 to rear housing inner valve seat 114.

Figure 4:
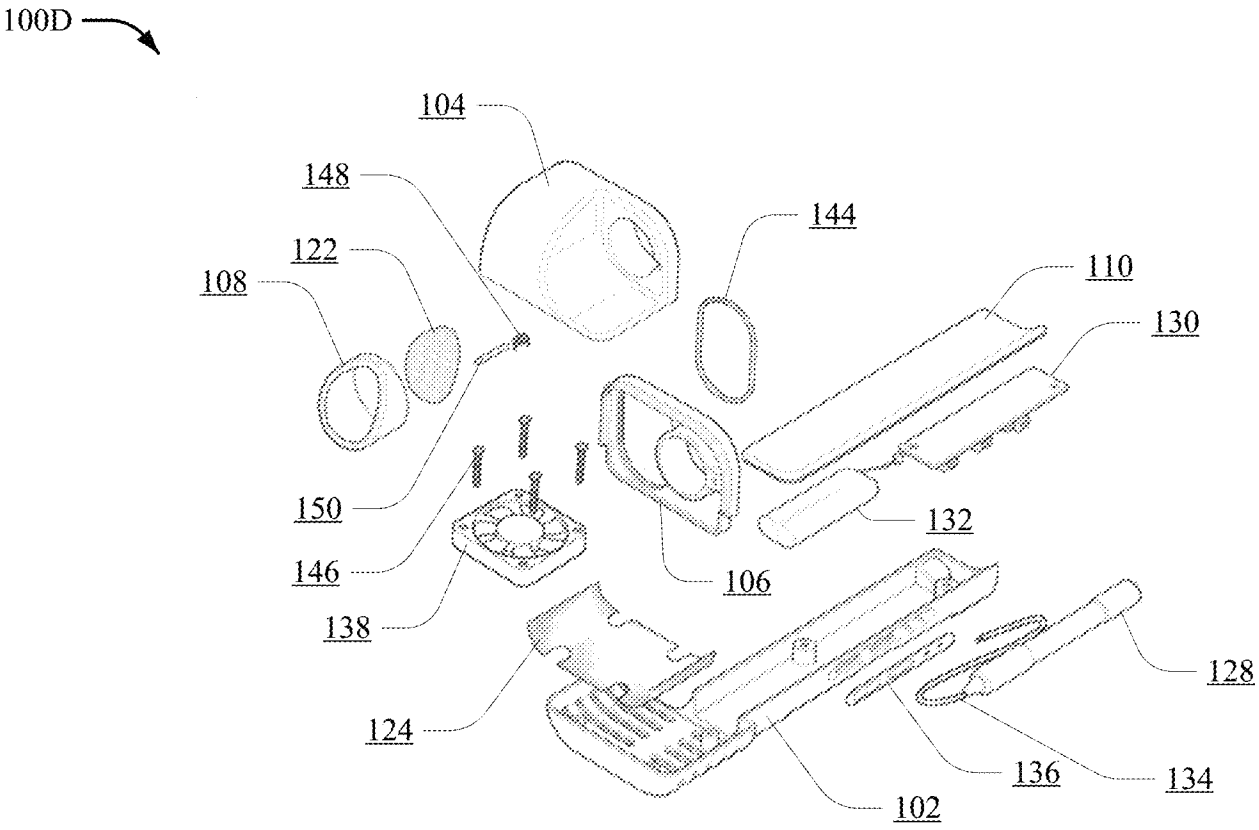
FIG. 4 illustrates a diagram of an example, exploded view of several non-limiting components of a system including one or more electromechanical components that can facilitate a filtered smoking of a cigarette or other combustible item in accordance with one or more embodiments described herein.

FIG. 4 illustrates a diagram of an example, exploded view of several non-limiting cleanable components of a system 100D including one or more electromechanical components that can facilitate a filtered smoking of a cigarette or other combustible item in accordance with one or more embodiments described herein. Repetitive description of like elements employed in other embodiments described herein is omitted for sake of brevity. In an aspect, all of the components illustrated in system 100D are included and/or part of system 100A-B and some components overlap with system 100C. In an aspect, some components of system 100A-C are not included in system 100D in order to have an unobstructed view of some of the system components. In an aspect, system 100D can comprise all of the elements of system 100A-C, but system 100D provides an exploded view illustration of fewer components in order to provide a better vantage point of several device components including main housing lower tray 102, main housing front cover 104, main housing front baffle 106, main housing igniter door 108, main housing electronics cover 110, igniter door filter 122, lower housing fan cover 124, igniter housing body 128, PC board 130, battery 132, igniter filament and wiring 134, membrane label cover 136, fan element 138, smoke tube O ring 144, screws 146, spring 148, and pin 150.

In an aspect, main housing lower tray 102 is configured to receive several components of system 100 including lower housing fan cover 124, PC board 130, and battery 132. In an aspect, the lower housing fan cover 124 can be configured to match the size of fan element 138. Furthermore, lower housing fan cover 124 can cover vented openings in the lower portion of lower housing fan cover 124. Furthermore, in an aspect, the vented openings can facilitate an outward venting of filtered second smoke and filtered third smoke out of system 100A-D based in part on a propulsion based air current created by fan element 138. Also shown in FIG. 4 are screws 146 which can be used to fasten fan element 138 into the main housing lower tray 102 atop of the vented openings. In other non-limiting embodiments, fan element 138 can be fastened to the main housing lower tray 102 by other means such as clipping, snapping, bolting, and other such means.

Furthermore, in an aspect, illustrated are main housing front baffle 106 configured to integrate with smoke tube 126 (not illustrated in FIG. 4), first filter 192 (not illustrated in FIG. 4), and main housing front cover 104. In between smoke tube 126 and main housing front baffle 106 can sit smoke tube O ring 144 to create a custom rubber seal between both components. Furthermore, in an aspect, smoke tube O ring 144 can comprise precise tolerances to various factors such as environmental, chemical, heat, or mechanical resistance. In another aspect, a main electronics housing cover 110 can be configured to encase a top portion of main housing lower tray 102 thus protecting the electronics such as PC board 130 and battery 132 located within the cavity of the main housing lower tray 102. Also illustrated are main housing igniter door 108, igniter door filter 122, spring 148 and pin 150. In an aspect, such components can be combined to form a door capable of swinging open and closed from main housing front cover 104. Also, in an aspect, pin 150 can act as a hinge that connects main housing igniter door 108 to main housing front cover 104.

In yet another aspect, illustrated in FIG. 4 is igniter housing body 128 as well as igniter filament and wiring 134. In an aspect, igniter housing body 128 can be configured to fit within the opening in main housing front cover 104 in order to be inserted in close enough proximity (e.g., touching) to cigarette 190 to cause such cigarette 190 to ignite for smoking. In another aspect, igniter housing body 128 can be configured to connect (e.g., snapping or clipping mechanism) onto the bottom surface of main housing lower tray 102. Furthermore, in an aspect, illustrate is membrane label cover 136 which can act as an interface to control various system 100A-D components. Also, in an aspect, membrane label cover 136 can comprise a master power switch and/or indicator lights for a device employing system 100A-D. In a non-limiting embodiment, a user interface can be integrated within system 100A-D to allow a user to interact with such interface (e.g., via touch, voice activation, etc.), retrieve information (e.g., data) related to the device or use of the device and/or input information (e.g., data, software updates, etc.) into the device.

Figure 5:
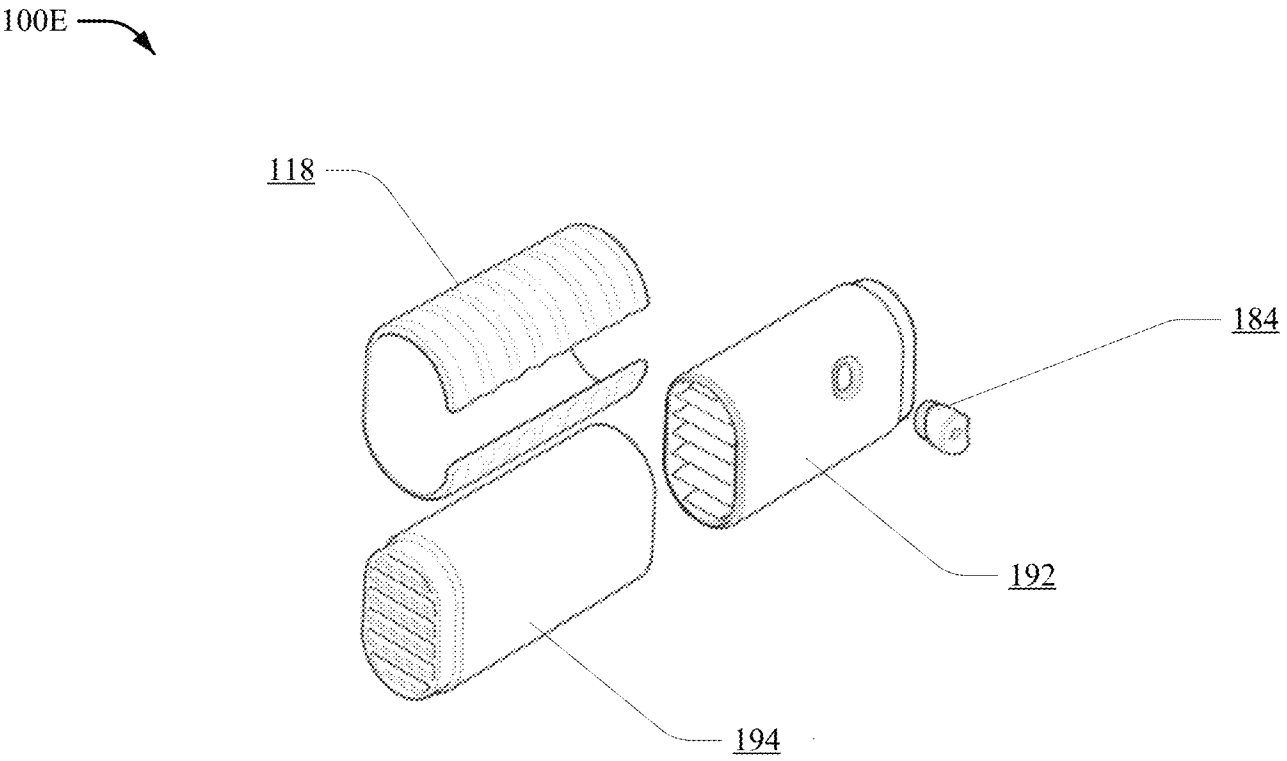
FIG. 5 illustrates a diagram of an example, exploded view of non-limiting filter components of a system that can facilitate a filtered smoking of a cigarette or other combustible item in accordance with one or more embodiments described herein.

FIG. 5 illustrates a diagram of an example, exploded view of non-limiting filter components of a system that can facilitate a filtered smoking of a cigarette or other combustible item in accordance with one or more embodiments described herein. Repetitive description of like elements employed in other embodiments described herein is omitted for sake of brevity. In an aspect, system 500 includes all of the elements of system 100, system 200, system 300, and system 400. In an aspect, all of the components illustrated in system 100E are included and/or part of system 100A-B and some components overlap with system 100C-D. In an aspect, some components of system 100A-D are not included in system 100D in order to have an unobstructed view of some of the system components (e.g., filters).

In an aspect, system 100E can comprise all of the elements of system 100A-D, but system 100E provides an exploded view illustration of fewer components in order to provide a better vantage point of several device components including first filter 192, second filter 194 grip 118, and mouth cover O ring 152. In another aspect, system 100E illustrates the filtration components that comprise a portion of the exhale chamber of systems 100A-E. In an instance first filter 192 can be a HEPA filter comprising a mat of randomly arranged fibers. In one or more non-limiting embodiment, the HEPA filters can vary in fiber diameter, filter thickness and face velocity. In an aspect, smoke contaminants and nuisance particles can be intercepted by first filter 192 fibers by adhering to such fibers. Furthermore, in an aspect, such smoke contaminants and particles can impact with the fibers based on the difficulty to avoid curving contours of such fibers within the filter. In yet another aspect, particles and nuisance contaminants from the smoke can diffuse through first filter 192 fibers thus slowing them down and increasing the chance that they will eventually be captured within first filter 192.

In another aspect, second filter 194 is illustrated and can comprise a charcoal filter that can utilize activated charcoal in one or more non-limiting embodiments. Furthermore, second filter 194 can further purify the smoke and air passing through its filter cavity by utilizing adsorption or chemical reaction techniques to remove impurities and contaminants within the smoke and air. In an aspect, particles from the smoke and air passing through second filter 194 can be trapped within the pores of activated carbon and thus further purify the smoke and air. In another aspect, grip 118 can wrap around second filter 194 and or first filter 192 in order to facilitate a user to grasp a device employing system 100-500 for smoking. Furthermore, in an aspect, grip 118 can be uncoiled such that it recoils around second filter 194 in a customized hugging configuration such that it can be a stable encasement circumscribing the outer surface of second filter 194 and/or first filter 192. In yet another aspect, mouth cover O ring 152 is also illustrated in FIG. 5 and can be inserted within first filter 192. Furthermore, mouth cover O ring 152 can be replaced on a reoccurring basis given that the orifice can become lined with second smoke contaminant and byproducts. Accordingly, any of the three components comprising of first filter 192, second filter 194, and/or mouth cover O ring 152 can be replaced at any time with a fresh, new component of the same type respectively.

Figure 6:
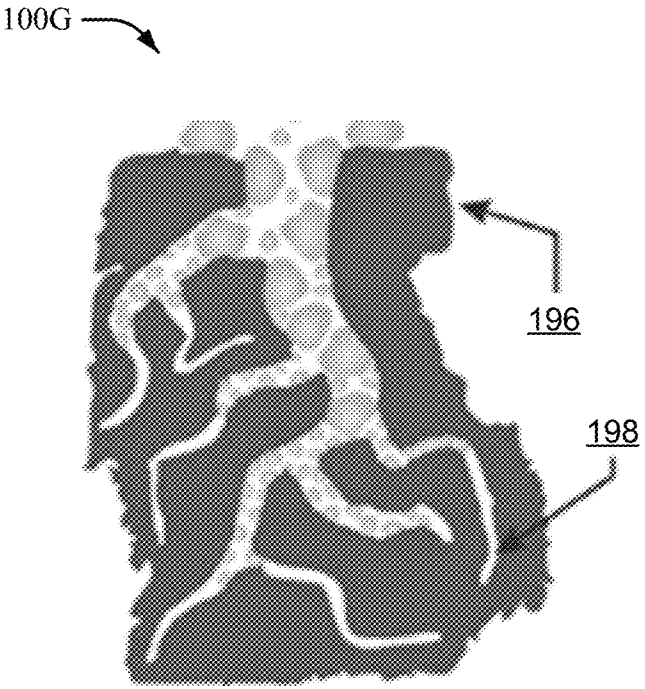
FIG. 6 illustrates a diagram of an example, non-limiting filter and filtering mechanism employed by a filter of the system that can facilitate a filtered smoking of a cigarette or other combustible item in accordance with one or more embodiments described herein.
Figure 6:
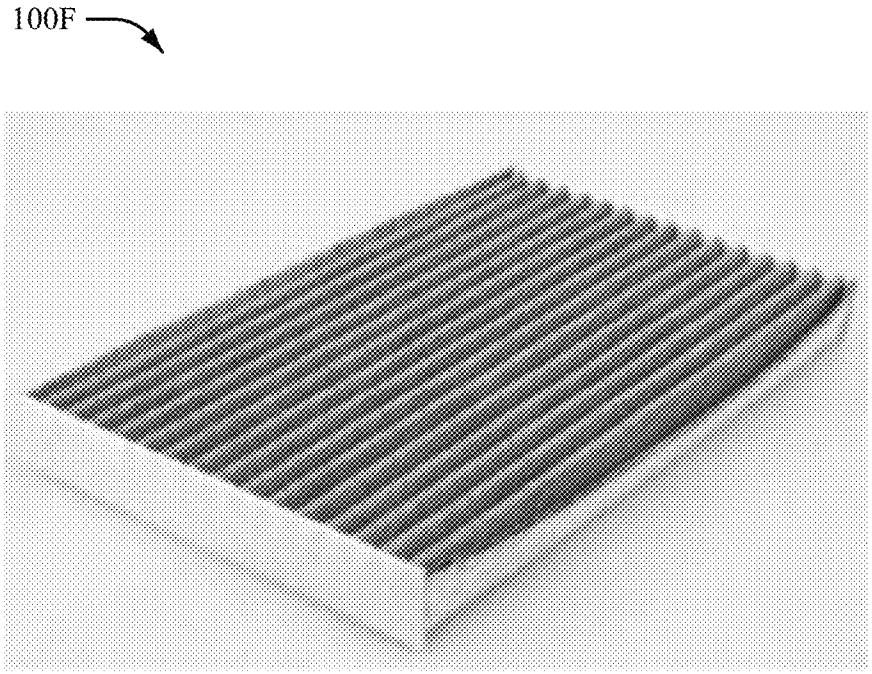

FIG. 6 illustrates a diagram of an example, non-limiting filter and filtering mechanism employed by a filter of the system that can facilitate a filtered smoking of a cigarette or other combustible item in accordance with one or more embodiments described herein. Repetitive description of like elements employed in other embodiments described herein is omitted for sake of brevity.

In an aspect, FIG. 6 illustrates a non-limiting example of a replaceable HEPA filter insert 100F capable of resting within second filter 194. In an aspect, such HEPA filter comprises folds of fibers capable of capturing contaminants within second smoke, third smoke and air via diffusion, interception and impact techniques. In another aspect, illustrated is activated charcoal 100G which can be present in second filter 194 in a non-limiting embodiment. Also, illustrated is activated carbon 196 and pores 198 which are illustrated capturing contaminants via an opening in the activated carbon 196 and within pores 198. In an aspect, the activated carbon 196 can absorb gases and chemicals from the smoke and air within the numerous pores of the charcoal.

Figure 7:
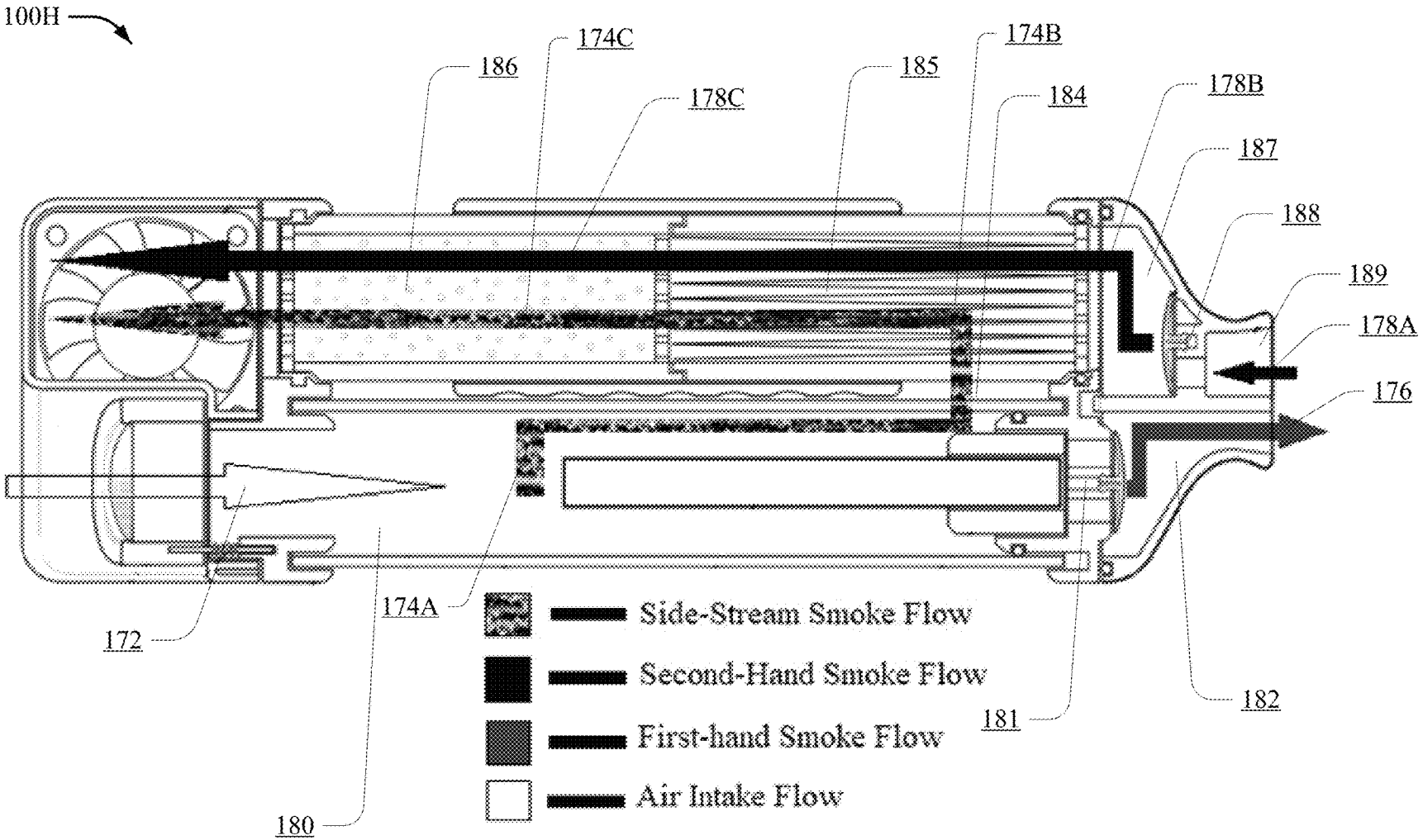
FIG. 7 illustrates a diagram of an example, cross sectional view of a non-limiting smoking system that can facilitate a filtered smoking of a cigarette or other combustible item and several channels of smoke capable of flowing throughout the device in accordance with one or more embodiments described herein.

FIG. 7 illustrates a diagram of an example, cross sectional view of a non-limiting smoking system 100H that can facilitate a filtered smoking of a cigarette or other combustible item and several channels of smoke capable of flowing throughout the device in accordance with one or more embodiments described herein. Repetitive description of like elements employed in other embodiments described herein is omitted for sake of brevity.

In an aspect, FIG. 7 illustrates, air intake flow 172, first flow of first smoke 176, first flow of second smoke 174A, second flow of second smoke 174B, third flow of second smoke 174C, first flow of third smoke 178A, second flow of third smoke 178B, and third flow of third smoke 178C. In an aspect air intake flow 172 represents air from the external environment that can be pulled through the igniter door filter 122 based on a pull force from a user inhalation through rear housing mouth cover 112. For instance, such inhalation can generate a vacuum effect that pulls air intake flow 172 through igniter door filter 122 into first hollow cavity portion 180 through first hollow tube portion 181, forcing open second valve 140B and entering second hollow cavity portion 182 into a user mouth. Aside from air intake flow 172 travelling through the inhale chamber, the oxygen from air intake flow 172 can facilitate the ignition of cigarette 190 and fuel the continued smoking of cigarette 190. For instance, oxygen (e.g., an oxidizing agent) in addition to heat (e.g., emanating from igniter housing body 128), and an active ingredient (e.g., *cannabis*, tobacco, etc.) can cause the cigarette 190 to ignite and can further aide in the continued smoking of cigarette 190 (e.g., continuous burning of cigarette 190 contents).

In another aspect, an ignited cigarette 190 can generate a first flow of second smoke 174A (e.g., also referred to as side-stream smoke flow) that can emanate from cigarette 190 and remain within first hollow cavity portion 180 of smoke tube 126. In an aspect, for ease of illustration the side-stream smoke flow is referenced with reference numerals 174A, 174B, 174C, merely to show a path of continuous smoke flow in a non-limiting embodiment of system 100A-H. As such, first flow of second smoke 174A can travel from within first hollow cavity portion 180 to inter-chamber orifice 184 (also referred to as mouth covering O ring 152. Furthermore, second flow of second smoke 174B can travel through the inter-chamber orifice 184 into first filter 192. In another aspect, third flow of second smoke 174C can travel from first filter 192 through second filter 194 and into the external environment through fan element 138 and out through one or more vent opening in main housing lower tray 102.

In yet another aspect, first flow of first smoke 176 (e.g., also referred to as first-hand smoke flow) can travel from within the barrel of cigarette 190, through the filter of cigarette 190 and into first hollow tube portion 181. The pull from a user inhalation can have already dislodged second valve 140B ajar and first flow of first smoke 176 can enter into second hollow cavity portion 182 and out of the opening in rear housing mouth cover 112 for a user to inhale. In yet another aspect, first flow of third smoke 178A (e.g., also referred to as second-hand smoke flow) can be exhaled by a user into an opening in rear housing mouth cover 112 and into mouthpiece cavity 189. Furthermore, in an aspect, the force from the exhaled third smoke can enter second hollow tube portion 188 and dislodge first valve 140A in order to enter third hollow cavity portion 187. As such, second flow of third smoke 178B can travel from third hollow cavity portion 187 to first filter 192 and through second filter 194 as third flow of third smoke 178C.

In another aspect, the pull force from fan element 138 and push force from a user exhalation can facilitate the movement and exiting of the third flow of third smoke 178C through fan element 138 and out vented openings in main housing lower tray 102. Furthermore, in an aspect, as air and/or smoke is inhaled through inhale tube, second valve 140B can open while third valve 140C can remain closed. As such, the first valve 140A and second valve 140B can face in opposite directions such that a force that opens one valve will force closed the other valve. For instance, an exhale force can force first valve 140A open and simultaneously force second valve 140B closed. Accordingly, a user can inhale and exhale routinely and the mechanisms between systems 100-700 allow for stratified opening and closing of first valve 140A and second valve 140B. Furthermore, if no pressure (e.g., from inhalation or exhalation) is exerted on either valve then first valve 140A and second valve 140B can remain closed.

Figure 8:
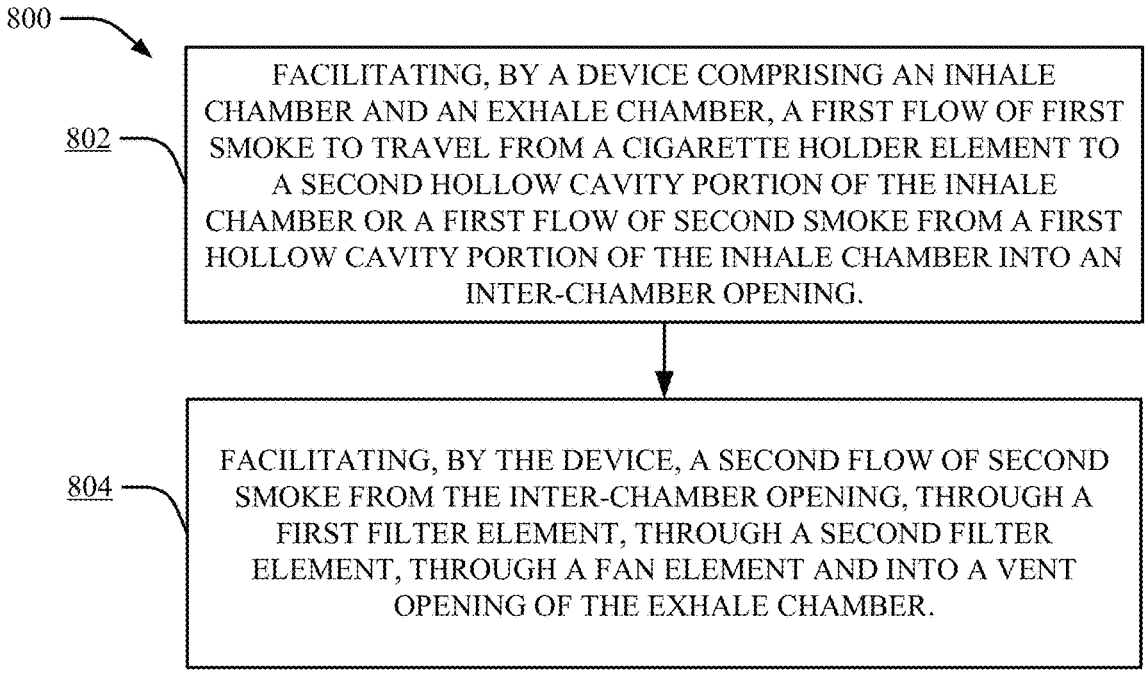
FIG. 8 illustrates a flow diagram of an example, non-limiting method that facilitates a filtered smoking of a cigarette or other combustible item using a device in accordance with one or more embodiments described herein.

FIG. 8 illustrates a flow diagram of an example, non-limiting method 800 that facilitates a filtered smoking of a cigarette or other combustible item using a device in accordance with one or more embodiments described herein.

In an aspect, one or more of the components described in method 800 can be electrically and/or communicatively coupled to the smoke filtering device. Repetitive description of like elements employed in other embodiments described herein is omitted for sake of brevity. In some implementations, at reference numeral 802, the device comprising an inhale chamber and an exhale chamber, can facilitate a first flow of first smoke to travel from a cigarette holder element to a second hollow cavity portion of the inhale chamber or a first flow of second smoke from a first hollow cavity portion of the inhale chamber into an inter-chamber opening. At reference numeral 804, the device can facilitate a second flow of second smoke from the inter-chamber opening, through a first filter element, through a second filter element, through a fan element and into a vent opening of the exhale chamber.

Figure 9:
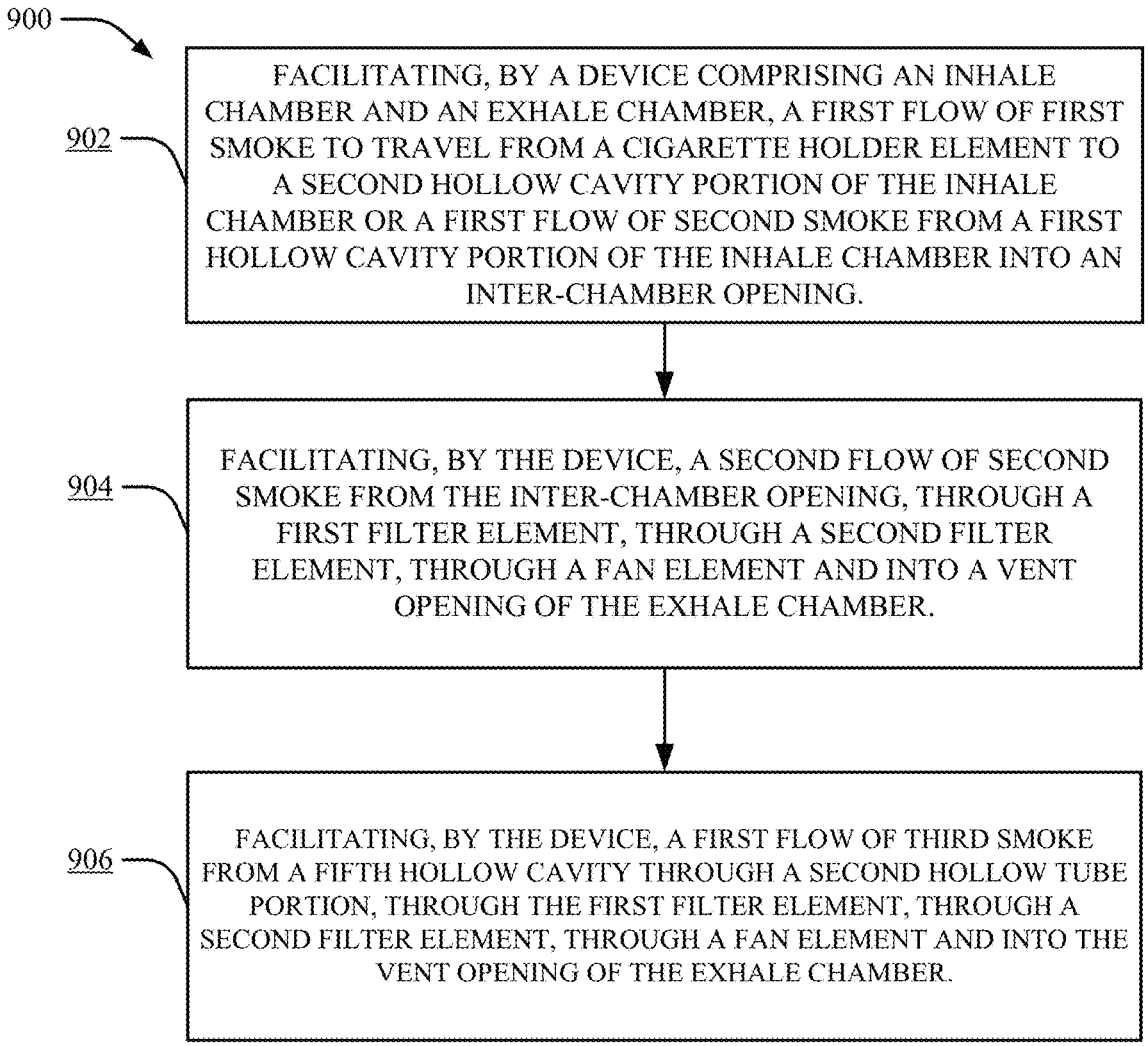
FIG. 9 illustrates a flow diagram of an example, non-limiting method that facilitates a filtered smoking of a cigarette or other combustible item using a device in accordance with one or more embodiments described herein.

FIG. 9 illustrates a flow diagram of an example, non-limiting method 900 that facilitates a filtered smoking of a cigarette or other combustible item using a device in accordance with one or more embodiments described herein. Repetitive description of like elements employed in other embodiments described herein is omitted for sake of brevity.

In an aspect, one or more of the components described in method 900 can be electrically and/or communicatively coupled to the smoke filtering device. In some implementations, at reference numeral 902, the device comprising an inhale chamber and an exhale chamber, can facilitate a first flow of first smoke to travel from a cigarette holder element to a second hollow cavity portion of the inhale chamber or a first flow of second smoke from a first hollow cavity portion of the inhale chamber into an inter-chamber opening. At reference numeral 904, the device can facilitate a second flow of second smoke from the inter-chamber opening, through a first filter element, through a second filter element, through a fan element and into a vent opening of the exhale chamber. At reference numeral 906, the device can facilitate a first flow of third smoke from a fifth hollow cavity through a second hollow tube portion, through the first filter element, through a second filter element, through a fan element and into the vent opening of the exhale chamber.

Figure 10:
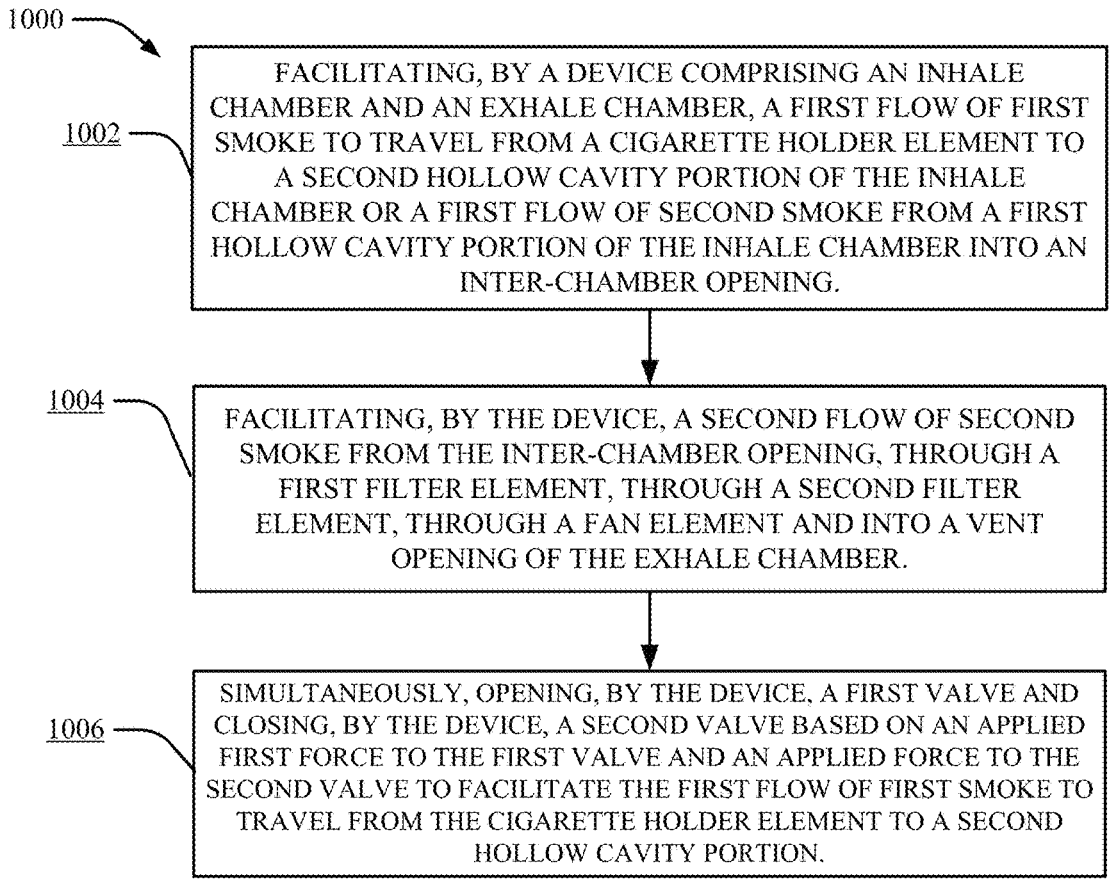
FIG. 10 illustrates a flow diagram of an example, non-limiting method that facilitates a filtered smoking of a cigarette or other combustible item using a device in accordance with one or more embodiments described herein.

FIG. 10 illustrates a flow diagram of an example, non-limiting method 1000 that facilitates a filtered smoking of a cigarette or other combustible item using a device in accordance with one or more embodiments described herein. Repetitive description of like elements employed in other embodiments described herein is omitted for sake of brevity.

In an aspect, one or more of the components described in method 1000 can be electrically and/or communicatively coupled to the smoke filtering device. In some implementations, at reference numeral 1002, the device comprising an inhale chamber and an exhale chamber, can facilitate a first flow of first smoke to travel from a cigarette holder element to a second hollow cavity portion of the inhale chamber or a first flow of second smoke from a first hollow cavity portion of the inhale chamber into an inter-chamber opening. At reference numeral 1004, the device can facilitate a second flow of second smoke from the inter-chamber opening, through a first filter element, through a second filter element, through a fan element and into a vent opening of the exhale chamber. At reference numeral 1006, the device can facilitate a simultaneous opening of a first valve and closing, by the device, a second valve based on an applied first force to the first valve and an applied force to the second valve to facilitate the first flow of first smoke to travel from the cigarette holder element to a second hollow cavity portion.

Figure 11:
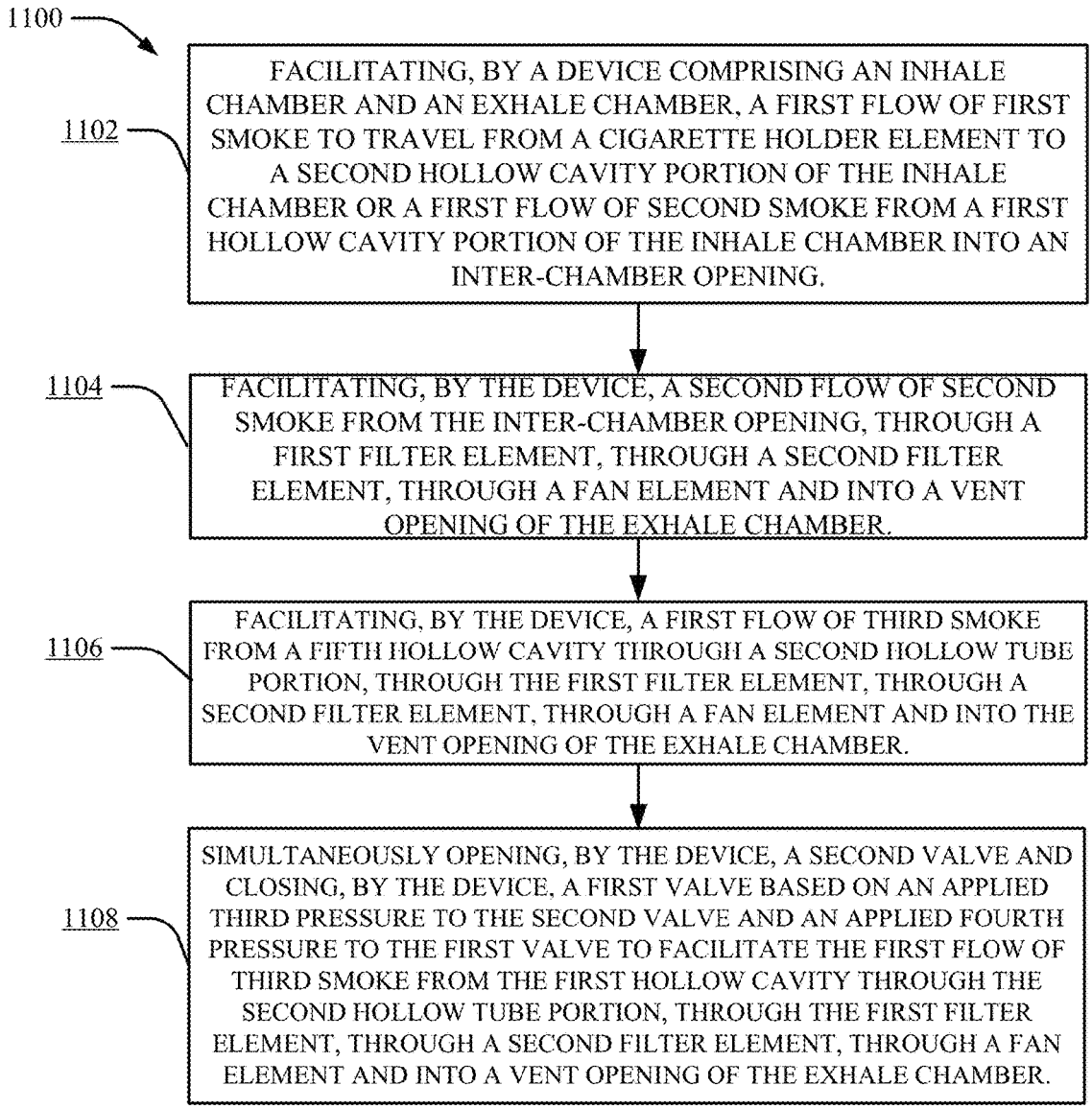
FIG. 11 illustrates a flow diagram of an example, non-limiting method that facilitates a filtered smoking of a cigarette or other combustible item using a device in accordance with one or more embodiments described herein.

FIG. 11 illustrates a flow diagram of an example, non-limiting method 1100 that facilitates a filtered smoking of a cigarette or other combustible item using a device in accordance with one or more embodiments described herein. Repetitive description of like elements employed in other embodiments described herein is omitted for sake of brevity.

In an aspect, one or more of the components described in method 1100 can be electrically and/or communicatively coupled to the smoke filtering device. In some implementations, at reference numeral 1102, the device comprising an inhale chamber and an exhale chamber, can facilitate a first flow of first smoke to travel from a cigarette holder element to a second hollow cavity portion of the inhale chamber or a first flow of second smoke from a first hollow cavity portion of the inhale chamber into an inter-chamber opening. At reference numeral 1104, the device can facilitate a second flow of second smoke from the inter-chamber opening, through a first filter element, through a second filter element, through a fan element and into a vent opening of the exhale chamber. At reference numeral 1106, the device can facilitate a first flow of third smoke from a fifth hollow cavity through a second hollow tube portion, through the first filter element, through a second filter element, through a fan element and into the vent opening of the exhale chamber. At reference numeral 1108, the device can facilitate a simultaneous opening of a first valve and closing, by the device, a second valve based on an applied first force to the first valve and an applied force to the second valve to facilitate the first flow of first smoke to travel from the cigarette holder element to a second hollow cavity portion.

Figure 12:
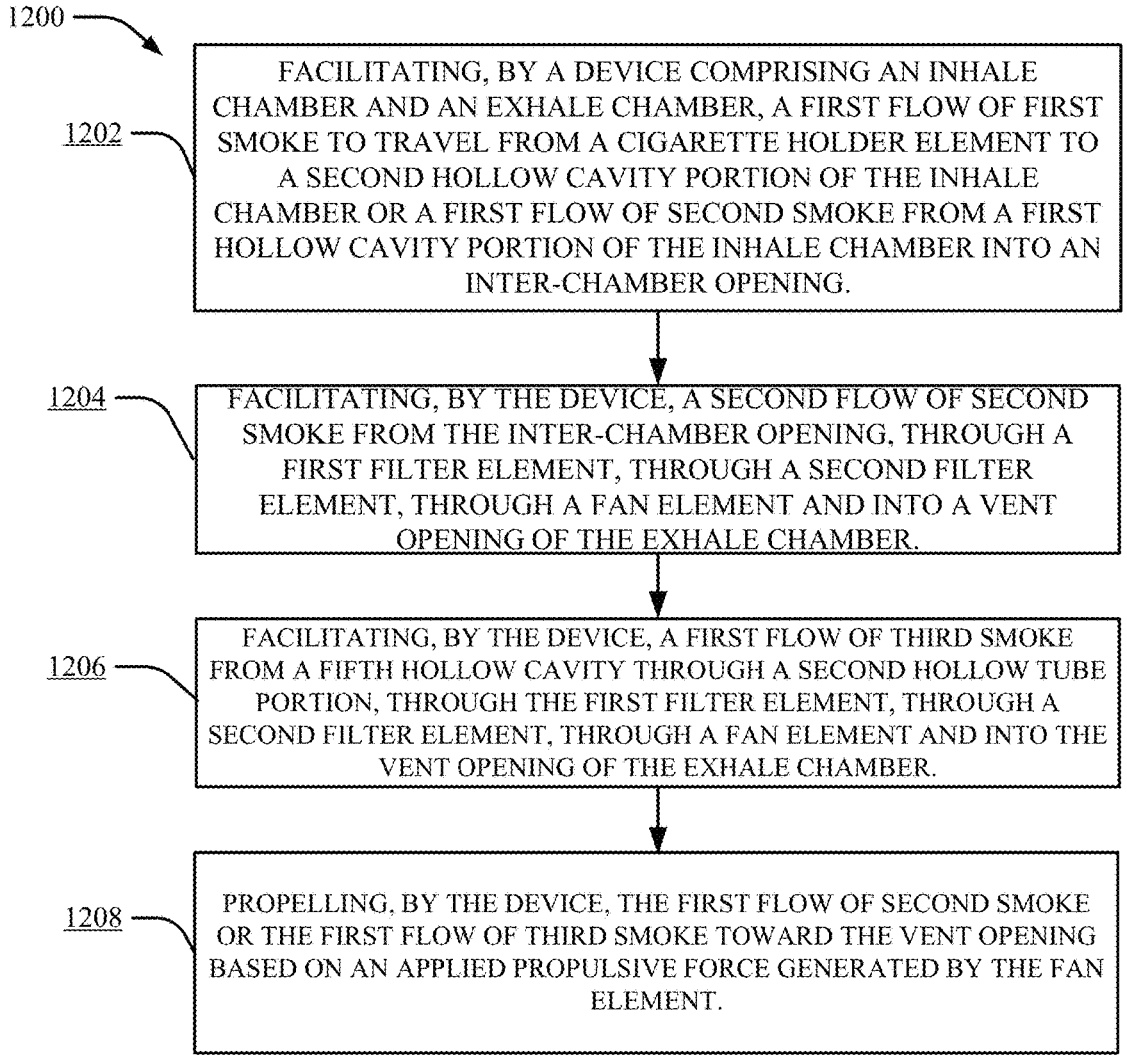
FIG. 12 illustrates a flow diagram of an example, non-limiting method that facilitates a filtered smoking of a cigarette or other combustible item using a device in accordance with one or more embodiments described herein.

FIG. 12 illustrates a flow diagram of an example, non-limiting method 1200 that facilitates a filtered smoking of a cigarette or other combustible item using a device in accordance with one or more embodiments described herein. Repetitive description of like elements employed in other embodiments described herein is omitted for sake of brevity.

In some implementations, at reference numeral 1202, the device comprising an inhale chamber and an exhale chamber, can facilitate a first flow of first smoke to travel from a cigarette holder element to a second hollow cavity portion of the inhale chamber or a first flow of second smoke from a first hollow cavity portion of the inhale chamber into an inter-chamber opening. At reference numeral 1204, the device can facilitate a second flow of second smoke from the inter-chamber opening, through a first filter element, through a second filter element, through a fan element and into a vent opening of the exhale chamber. At reference numeral 1206, the device can facilitate a first flow of third smoke from a fifth hollow cavity through a second hollow tube portion, through the first filter element, through a second filter element, through a fan element and into the vent opening of the exhale chamber. At reference numeral 1208, the device can propel the second flow of second smoke or the first flow of third smoke toward the vent opening based on an applied propulsive force generated by the fan element.

Figure 13:
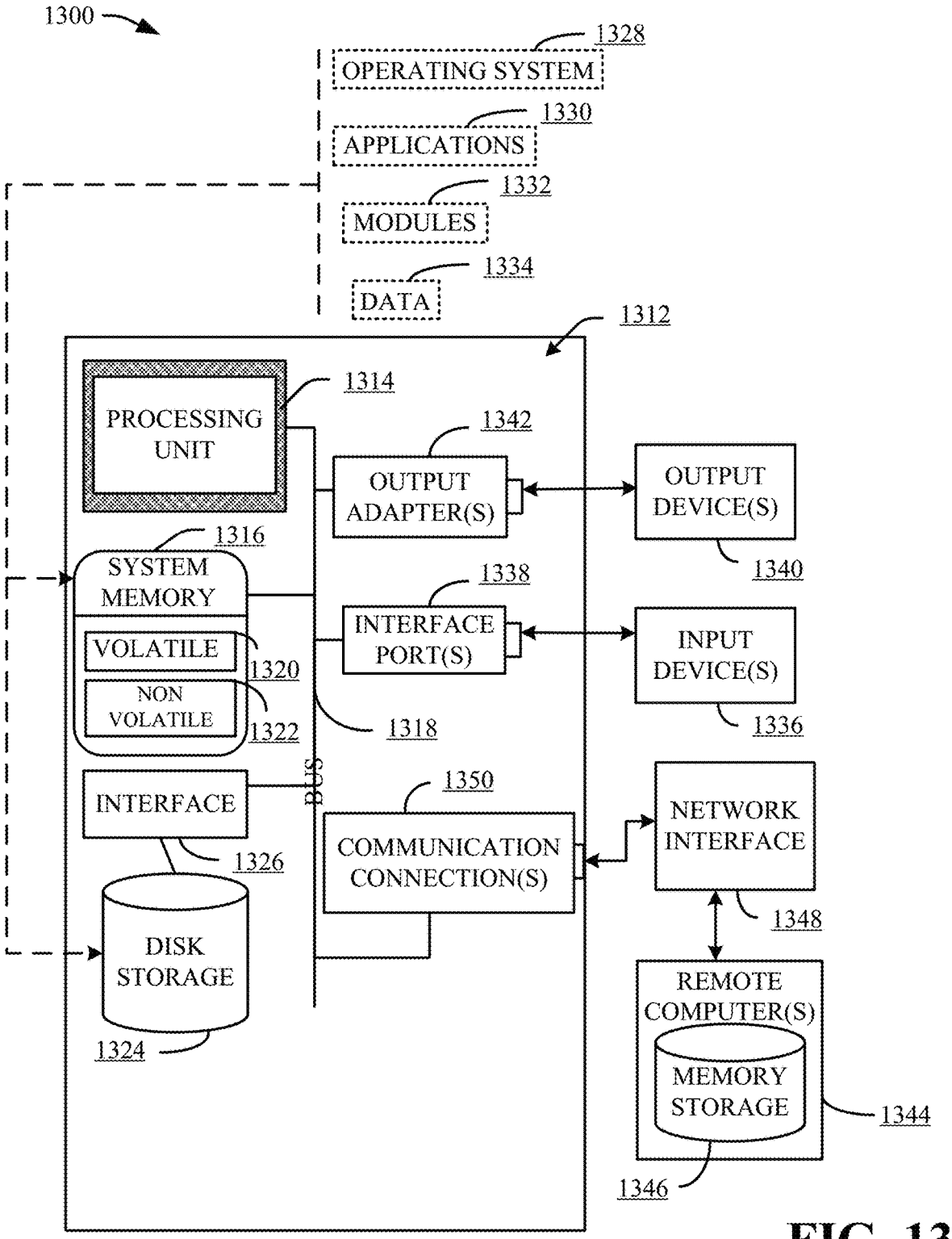
FIG. 13 illustrates a flow diagram of an example, non-limiting computer-implemented method that facilitates a configuration of the first device from an application executing on a second device in accordance with one or more embodiments described herein.
Figure 14:
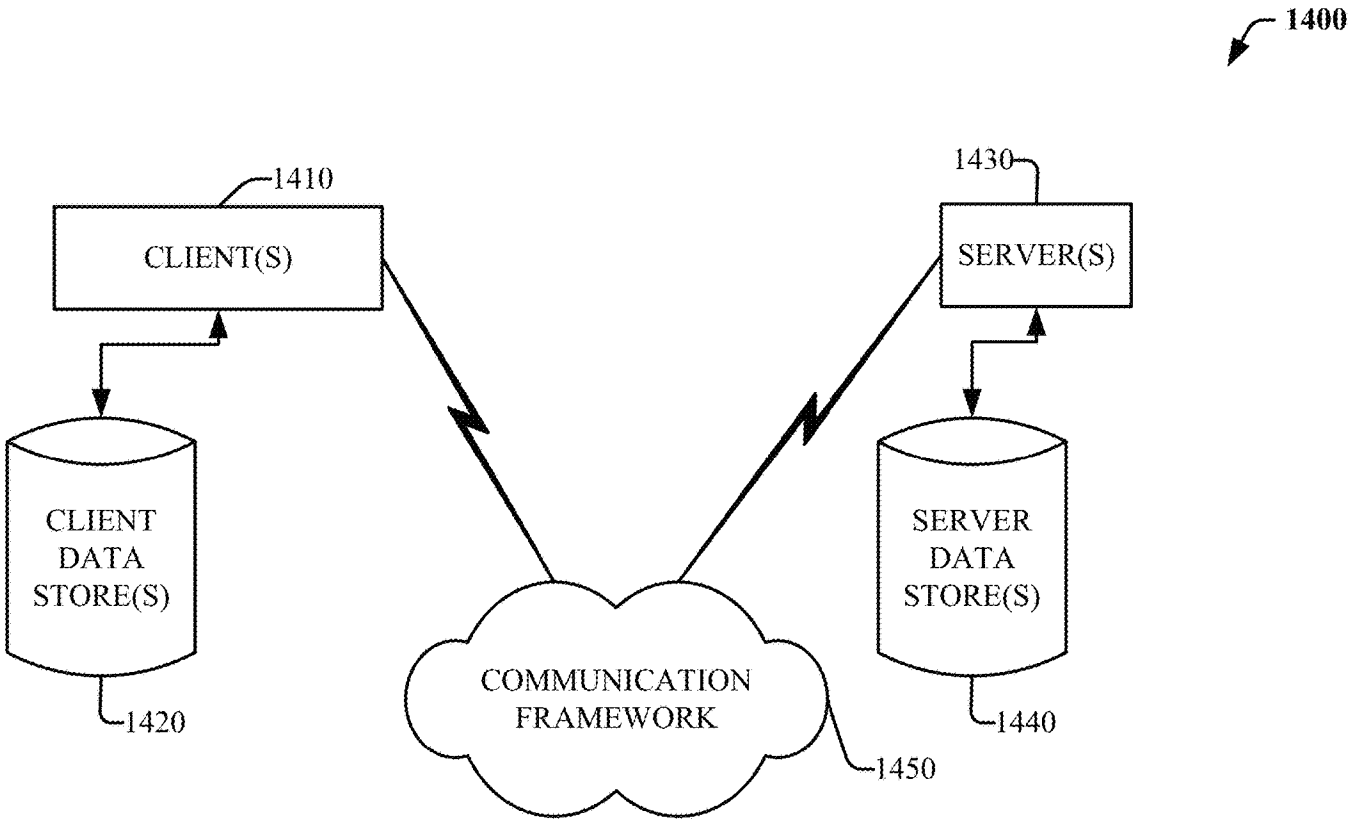
FIG. 14 illustrates a block diagram of an example, non-limiting operating environment in which one or more embodiments described herein can be facilitated.

In order to provide a context for the various aspects of the disclosed subject matter, FIG. 13 as well as the following discussion is intended to provide a general description of a suitable environment in which the various aspects of the disclosed subject matter can be implemented. FIG. 13 illustrates a block diagram of an example, non-limiting operating environment in which one or more embodiments described herein can be facilitated. With reference to FIG. 13, a suitable operating environment 1300 for implementing various aspects of this disclosure can also include a computer 1312. The computer 1312 can also include a processing unit 1314, a system memory 1316, and a system bus 1318. The system bus 1318 couples system components including, but not limited to, the system memory 1316 to the processing unit 1314. The processing unit 1314 can be any of various available processors. Dual microprocessors and other multiprocessor architectures also can be employed as the processing unit 1314. The system bus 1318 can be any of several types of bus structure(s) including the memory bus or memory controller, a peripheral bus or external bus, and/or a local bus using any variety of available bus architectures including, but not limited to, Industrial Standard Architecture (ISA), Micro-Channel Architecture (MSA), Extended ISA (EISA), Intelligent Drive Electronics (IDE), VESA Local Bus (VLB), Peripheral Component Interconnect (PCI), Card Bus, Universal Serial Bus (USB), Advanced Graphics Port (AGP), Firewire (IEEE 1394), and Small Computer Systems Interface (SCSI).

The system memory 1316 can also include volatile memory 1320 and nonvolatile memory 1322. The basic input/output system (BIOS), containing the basic routines to transfer information between elements within the computer 1312, such as during start-up, is stored in nonvolatile memory 1322. By way of illustration, and not limitation, nonvolatile memory 1322 can include read only memory (ROM), programmable ROM (PROM), electrically programmable ROM (EPROM), electrically erasable programmable ROM (EEPROM), flash memory, or nonvolatile random access memory (RAM) (e.g., ferroelectric RAM (FeRAM). Volatile memory 1320 can also include random access memory (RAM), which acts as external cache memory. By way of illustration and not limitation, RAM is available in many forms such as static RAM (SRAM), dynamic RAM (DRAM), synchronous DRAM (SDRAM), double data rate SDRAM (DDR SDRAM), enhanced SDRAM (ESDRAM), Synchlink DRAM (SLDRAM), direct Rambus RAM (DRRAM), direct Rambus dynamic RAM (DRDRAM), and Rambus dynamic RAM.

Computer 1312 can also include removable/non-removable, volatile/non-volatile computer storage media. FIG. 13 illustrates, for example, a disk storage 1324. Disk storage 1324 can also include, but is not limited to, devices like a magnetic disk drive, floppy disk drive, tape drive, Jaz drive, Zip drive, LS-100 drive, flash memory card, or memory stick. The disk storage 1324 also can include storage media separately or in combination with other storage media including, but not limited to, an optical disk drive such as a compact disk ROM device (CD-ROM), CD recordable drive (CD-R Drive), CD rewritable drive (CD-RW Drive) or a digital versatile disk ROM drive (DVD-ROM). To facilitate connection of the disk storage 1324 to the system bus 1318, a removable or non-removable interface is typically used, such as interface 1326. FIG. 13 also depicts software that acts as an intermediary between users and the basic computer resources described in the suitable operating environment 1300. Such software can also include, for example, an operating system 1328. Operating system 1328, which can be stored on disk storage 1324, acts to control and allocate resources of the computer 1312.

System applications 1330 take advantage of the management of resources by operating system 1328 through program modules 1332 and program data 1334, e.g., stored either in system memory 1316 or on disk storage 1324. It is to be appreciated that this disclosure can be implemented with various operating systems or combinations of operating systems. A user enters commands or information into the computer 1312 through input device(s) 1336. Input devices 1336 include, but are not limited to, a pointing device such as a mouse, trackball, stylus, touch pad, keyboard, microphone, joystick, game pad, satellite dish, scanner, TV tuner card, digital camera, digital video camera, web camera, and the like. These and other input devices connect to the processing unit 1314 through the system bus 1318 via interface port(s) 1338. Interface port(s) 1338 include, for example, a serial port, a parallel port, a game port, and a universal serial bus (USB). Output device(s) 1340 use some of the same type of ports as input device(s) 1336. Thus, for example, a USB port can be used to provide input to computer 1312, and to output information from computer 1312 to an output device 1340. Output adapter 1242 is provided to illustrate that there are some output device 1340 like monitors, speakers, and printers, among other such output device 1340, which require special adapters. The output adapters 1342 include, by way of illustration and not limitation, video and sound cards that provide a means of connection between the output device 1340 and the system bus 1318. It should be noted that other devices and/or systems of devices provide both input and output capabilities such as remote computer(s) 1344.

Computer 1312 can operate in a networked environment using logical connections to one or more remote computers, such as remote computer(s) 1344. The remote computer(s) 1344 can be a computer, a server, a router, a network PC, a workstation, a microprocessor based appliance, a peer device or other common network node and the like, and typically can also include many or all of the elements described relative to computer 1312. For purposes of brevity, only a memory storage device 1346 is illustrated with remote computer(s) 1344. Remote computer(s) 1344 is logically connected to computer 1312 through a network interface 1348 and then physically connected via communication connection 1350. Network interface 1348 encompasses wire and/or wireless communication networks such as local-area networks (LAN), wide-area networks (WAN), cellular networks, etc. LAN technologies include Fiber Distributed Data Interface (FDDI), Copper Distributed Data Interface (CDDI), Ethernet, Token Ring and the like. WAN technologies include, but are not limited to, point-to-point links, circuit switching networks like Integrated Services Digital Networks (ISDN) and variations thereon, packet switching networks, and Digital Subscriber Lines (DSL). Communication connection(s) 1350 refers to the hardware/software employed to connect the network interface 1348 to the system bus 1318. While communication connection 1350 is shown for illustrative clarity inside computer 1312, it can also be external to computer 1312. The hardware/software for connection to the network interface 1348 can also include, for exemplary purposes only, internal and external technologies such as, modems including regular telephone grade modems, cable modems and DSL modems, ISDN adapters, and Ethernet cards.

The present disclosure may be a system, a method, an apparatus and/or a computer program product at any possible technical detail level of integration. The computer program product can include a computer readable storage medium (or media) having computer readable program instructions thereon for causing a processor to carry out aspects of the present disclosure. The computer readable storage medium can be a tangible device that can retain and store instructions for use by an instruction execution device. The computer readable storage medium can be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium can also include the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network can comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device. Computer readable program instructions for carrying out operations of the present disclosure can be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions can execute entirely on the user's computer, partly on the user's computer, as a stand-alone software package, partly on the user's computer and partly on a remote computer or entirely on the remote computer or server. In the latter scenario, the remote computer can be connected to the user's computer through any type of network, including a local area network (LAN) or a wide area network (WAN), or the connection can be made to an external computer (for example, through the Internet using an Internet Service Provider). In some embodiments, electronic circuitry including, for example, programmable logic circuitry, field-programmable gate arrays (FPGA), or programmable logic arrays (PLA) can execute the computer readable program instructions by utilizing state information of the computer readable program instructions to personalize the electronic circuitry, in order to perform aspects of the present disclosure.

Aspects of the present disclosure are described herein with reference to flowchart illustrations and/or block diagrams of methods, apparatus (systems), and computer program products according to embodiments of the disclosure. It will be understood that each block of the flowchart illustrations and/or block diagrams, and combinations of blocks in the flowchart illustrations and/or block diagrams, can be implemented by computer readable program instructions. These computer readable program instructions can be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions can also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks. The computer readable program instructions can also be loaded onto a computer, other programmable data processing apparatus, or other device to cause a series of operational acts to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present disclosure. In this regard, each block in the flowchart or block diagrams can represent a module, segment, or portion of instructions, which comprises one or more executable instructions for implementing the specified logical function(s). In some alternative implementations, the functions noted in the blocks can occur out of the order noted in the Figures. For example, two blocks shown in succession can, in fact, be executed substantially concurrently, or the blocks can sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

While the subject matter has been described above in the general context of computer-executable instructions of a computer program product that runs on a computer and/or computers, those skilled in the art will recognize that this disclosure also can or can be implemented in combination with other program modules. Generally, program modules include routines, programs, components, data structures, etc. that perform particular tasks and/or implement particular abstract data types. Moreover, those skilled in the art will appreciate that the inventive computer-implemented methods can be practiced with other computer system configurations, including single-processor or multiprocessor computer systems, mini-computing devices, mainframe computers, as well as computers, hand-held computing devices (e.g., PDA, phone), microprocessor-based or programmable consumer or industrial electronics, and the like. The illustrated aspects can also be practiced in distributed computing environments in which tasks are performed by remote processing devices that are linked through a communications network. However, some, if not all aspects of this disclosure can be practiced on stand-alone computers. In a distributed computing environment, program modules can be located in both local and remote memory storage devices.

As used in this application, the terms "component," "system," "platform," "interface," and the like, can refer to and/or can include a computer-related entity or an entity related to an operational machine with one or more specific functionalities. The entities disclosed herein can be either hardware, a combination of hardware and software, software, or software in execution. For example, a component can be, but is not limited to being, a process running on a processor, a processor, an object, an executable, a thread of execution, a program, and/or a computer. By way of illustration, both an application running on a server and the server can be a component. One or more components can reside within a process and/or thread of execution and a component can be localized on one computer and/or distributed between two or more computers. In another example, respective components can execute from various computer readable media having various data structures stored thereon. The components can communicate via local and/or remote processes such as in accordance with a signal having one or more data packets (e.g., data from one component interacting with another component in a local system, distributed system, and/or across a network such as the Internet with other systems via the signal). As another example, a component can be an apparatus with specific functionality provided by mechanical parts operated by electric or electronic circuitry, which is operated by a software or firmware application executed by a processor. In such a case, the processor can be internal or external to the apparatus and can execute at least a part of the software or firmware application. As yet another example, a component can be an apparatus that provides specific functionality through electronic components without mechanical parts, wherein the electronic components can include a processor or other means to execute software or firmware that confers at least in part the functionality of the electronic components. In an aspect, a component can emulate an electronic component via a virtual machine, e.g., within a cloud computing system.

In addition, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Moreover, articles "a" and "an" as used in the subject specification and annexed drawings should generally be construed to mean "one or more" unless specified otherwise or clear from context to be directed to a singular form. As used herein, the terms "example" and/or "exemplary" are utilized to mean serving as an example, instance, or illustration. For the avoidance of doubt, the subject matter disclosed herein is not limited by such examples. In addition, any aspect or design described herein as an "example" and/or "exemplary" is not necessarily to be construed as preferred or advantageous over other aspects or designs, nor is it meant to preclude equivalent exemplary structures and techniques known to those of ordinary skill in the art.

As it is employed in the subject specification, the term "processor" can refer to substantially any computing processing unit or device comprising, but not limited to, single-core processors; single-processors with software multithread execution capability; multi-core processors; multi-core processors with software multithread execution capability; multi-core processors with hardware multithread technology; parallel platforms; and parallel platforms with distributed shared memory. Additionally, a processor can refer to an integrated circuit, an application specific integrated circuit (ASIC), a digital signal processor (DSP), a field programmable gate array (FPGA), a programmable logic controller (PLC), a complex programmable logic device (CPLD), a discrete gate or transistor logic, discrete hardware components, or any combination thereof designed to perform the functions described herein. Further, processors can exploit nano-scale architectures such as, but not limited to, molecular and quantum-dot based transistors, switches and gates, in order to optimize space usage or enhance performance of user equipment. A processor can also be implemented as a combination of computing processing units. In this disclosure, terms such as "store," "storage," "data store," data storage," "database," and substantially any other information storage component relevant to operation and functionality of a component are utilized to refer to "memory components," entities embodied in a "memory," or components comprising a memory. It is to be appreciated that memory and/or memory components described herein can be either volatile memory or nonvolatile memory, or can include both volatile and nonvolatile memory. By way of illustration, and not limitation, nonvolatile memory can include read only memory (ROM), programmable ROM (PROM), electrically programmable ROM (EPROM), electrically erasable ROM (EEPROM), flash memory, or nonvolatile random access memory (RAM) (e.g., ferroelectric RAM (FeRAM). Volatile memory can include RAM, which can act as external cache memory, for example. By way of illustration and not limitation, RAM is available in many forms such as synchronous RAM (SRAM), dynamic RAM (DRAM), synchronous DRAM (SDRAM), double data rate SDRAM (DDR SDRAM), enhanced SDRAM (ESDRAM), Synchlink DRAM (SLDRAM), direct Rambus RAM (DRRAM), direct Rambus dynamic RAM (DRDRAM), and Rambus dynamic RAM (RDRAM). Additionally, the disclosed memory components of systems or computer-implemented methods herein are intended to include, without being limited to including, these and any other suitable types of memory.

What has been described above include mere examples of systems and computer-implemented methods. It is, of course, not possible to describe every conceivable combination of components or computer-implemented methods for purposes of describing this disclosure, but one of ordinary skill in the art can recognize that many further combinations and permutations of this disclosure are possible. Furthermore, to the extent that the terms "includes," "has," "possesses," and the like are used in the detailed description, claims, appendices and drawings such terms are intended to be inclusive in a manner similar to the term "comprising" as "comprising" is interpreted when employed as a transitional word in a claim.

The descriptions of the various embodiments have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

Referring now to FIG. 13, there is illustrated a schematic block diagram of a computing environment 1300 in accordance with this disclosure. The system 1300 includes one or more client(s) 1302 (e.g., laptops, smart phones, PDAs, media players, computers, portable electronic devices, tablets, and the like). The client(s) 1302 can be hardware and/or software (e.g., threads, processes, computing devices). The system 1300 also includes one or more server(s) 1304. The server(s) 1304 can also be hardware or hardware in combination with software (e.g., threads, processes, computing devices). The servers 1304 can house threads to perform transformations by employing aspects of this disclosure, for example. One possible communication between a client 1302 and a server 1304 can be in the form of a data packet transmitted between two or more computer processes wherein the data packet may include video data. The data packet can include a metadata, e.g., associated contextual information, for example. The system 1300 includes a communication framework 1306 (e.g., a global communication network such as the Internet, or mobile network(s)) that can be employed to facilitate communications between the client(s) 1302 and the server(s) 1304.

Communications can be facilitated via a wired (including optical fiber) and/or wireless technology. The client(s) 1302 include or are operatively connected to one or more client data store(s) 1308 that can be employed to store information local to the client(s) 1302 (e.g., associated contextual information). Similarly, the server(s) 1304 are operatively include or are operatively connected to one or more server data store(s) 1310 that can be employed to store information local to the servers 1304.

In one embodiment, a client 1302 can transfer an encoded file, in accordance with the disclosed subject matter, to server 1304. Server 1304 can store the file, decode the file, or transmit the file to another client 1302. It is to be appreciated, that a client 1302 can also transfer uncompressed file to a server 1304 and server 1304 can compress the file in accordance with the disclosed subject matter. Likewise, server 1304 can encode video information and transmit the information via communication framework 1306 to one or more clients 1302.

The illustrated aspects of the disclosure may also be practiced in distributed computing environments where certain tasks are performed by remote processing devices that are linked through a communications network. In a distributed computing environment, program modules can be located in both local and remote memory storage devices.

Moreover, it is to be appreciated that various components described in this description can include electrical circuit(s) that can include components and circuitry elements of suitable value in order to implement the embodiments of the subject innovation(s). Furthermore, it can be appreciated that many of the various components can be implemented on one or more integrated circuit (IC) chips. For example, in one embodiment, a set of components can be implemented in a single IC chip. In other embodiments, one or more of respective components are fabricated or implemented on separate IC chips.

What has been described above includes examples of the embodiments of the present invention. It is, of course, not possible to describe every conceivable combination of components or methodologies for purposes of describing the claimed subject matter, but it is to be appreciated that many further combinations and permutations of the subject innovation are possible. Accordingly, the claimed subject matter is intended to embrace all such alterations, modifications, and variations that fall within the spirit and scope of the appended claims. Moreover, the above description of illustrated embodiments of the subject disclosure, including what is described in the Abstract, is not intended to be exhaustive or to limit the disclosed embodiments to the precise forms disclosed. While specific embodiments and examples are described in this disclosure for illustrative purposes, various modifications are possible that are considered within the scope of such embodiments and examples, as those skilled in the relevant art can recognize.

In particular and in regard to the various functions performed by the above described components, devices, circuits, systems and the like, the terms used to describe such components are intended to correspond, unless otherwise indicated, to any component which performs the specified function of the described component (e.g., a functional equivalent), even though not structurally equivalent to the disclosed structure, which performs the function in the disclosure illustrated exemplary aspects of the claimed subject matter. In this regard, it will also be recognized that the innovation includes a system as well as a computer-readable storage medium having computer-executable instructions for performing the acts and/or events of the various methods of the claimed subject matter.

The aforementioned systems/circuits/modules have been described with respect to interaction between several components/blocks. It can be appreciated that such systems/circuits and components/blocks can include those components or specified sub-components, some of the specified components or sub-components, and/or additional components, and according to various permutations and combinations of the foregoing. Sub-components can also be implemented as components communicatively coupled to other components rather than included within parent components (hierarchical). Additionally, it should be noted that one or more components may be combined into a single component providing aggregate functionality or divided into several separate sub-components, and any one or more middle layers, such as a management layer, may be provided to communicatively couple to such sub-components in order to provide integrated functionality. Any components described in this disclosure may also interact with one or more other components not specifically described in this disclosure but known by those of skill in the art.

In addition, while a particular feature of the subject innovation may have been disclosed with respect to only one of several implementations, such feature may be combined with one or more other features of the other implementations as may be desired and advantageous for any given or particular application. Furthermore, to the extent that the terms "includes," "including," "has," "contains," variants thereof, and other similar words are used in either the detailed description or the claims, these terms are intended to be inclusive in a manner similar to the term "comprising" as an open transition word without precluding any additional or other elements.

As used in this application, the terms "component," "module," "system," or the like are generally intended to refer to a computer-related entity, either hardware (e.g., a circuit), a combination of hardware and software, software, or an entity related to an operational machine with one or more specific functionalities. For example, a component may be, but is not limited to being, a process running on a processor (e.g., digital signal processor), a processor, an object, an executable, a thread of execution, a program, and/or a computer. By way of illustration, both an application running on a controller and the controller can be a component. One or more components may reside within a process and/or thread of execution and a component may be localized on one computer and/or distributed between two or more computers. Further, a "device" can come in the form of specially designed hardware; generalized hardware made specialized by the execution of software thereon that enables the hardware to perform specific function; software stored on a computer readable storage medium; software transmitted on a computer readable transmission medium; or a combination thereof.

Moreover, the words "example" or "exemplary" are used in this disclosure to mean serving as an example, instance, or illustration. Any aspect or design described in this disclosure as "exemplary" is not necessarily to be construed as preferred or advantageous over other aspects or designs. Rather, use of the words "example" or "exemplary" is intended to present concepts in a concrete fashion. As used in this application, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Computing devices typically include a variety of media, which can include computer-readable storage media and/or communications media, in which these two terms are used in this description differently from one another as follows. Computer-readable storage media can be any available storage media that can be accessed by the computer, is typically of a non-transitory nature, and can include both volatile and nonvolatile media, removable and non-removable media. By way of example, and not limitation, computer-readable storage media can be implemented in connection with any method or technology for storage of information such as computer-readable instructions, program modules, structured data, or unstructured data. Computer-readable storage media can include, but are not limited to, RAM, ROM, EEPROM, flash memory or other memory technology, CD-ROM, digital versatile disk (DVD) or other optical disk storage, magnetic cassettes, magnetic tape, magnetic disk storage or other magnetic storage devices, or other tangible and/or non-transitory media which can be used to store desired information. Computer-readable storage media can be accessed by one or more local or remote computing devices, e.g., via access requests, queries or other data retrieval protocols, for a variety of operations with respect to the information stored by the medium.

On the other hand, communications media typically embody computer-readable instructions, data structures, program modules or other structured or unstructured data in a data signal that can be transitory such as a modulated data signal, e.g., a carrier wave or other transport mechanism, and includes any information delivery or transport media. The term "modulated data signal" or signals refers to a signal that has one or more of its characteristics set or changed in such a manner as to encode information in one or more signals. By way of example, and not limitation, communication media include wired media, such as a wired network or direct-wired connection, and wireless media such as acoustic, RF, infrared and other wireless media.

In view of the exemplary systems described above, methodologies that may be implemented in accordance with the described subject matter will be better appreciated with reference to the flowcharts of the various figures. For simplicity of explanation, the methodologies are depicted and described as a series of acts. However, acts in accordance with this disclosure can occur in various orders and/or concurrently, and with other acts not presented and described in this disclosure. Furthermore, not all illustrated acts may be required to implement the methodologies in accordance with certain aspects of this disclosure. In addition, those skilled in the art will understand and appreciate that the methodologies could alternatively be represented as a series of interrelated states via a state diagram or events. Additionally, it should be appreciated that the methodologies disclosed in this disclosure are capable of being stored on an article of manufacture to facilitate transporting and transferring such methodologies to computing devices. The term article of manufacture, as used in this disclosure, is intended to encompass a computer program accessible from any computer-readable device or storage media.

What is claimed is:

1. A system comprising:

an inhale chamber comprising a first front portion, a first body portion, and a first rear portion, wherein a cigarette holder element affixed to a rear housing mouth cover of the first rear portion and located within a first hollow cavity portion of the first body portion, and wherein a first valve capable of sealing or unsealing an opening within a first hollow tube portion is located within a second hollow cavity portion of the first rear portion and within the first hollow tube portion that connects the first hollow cavity portion to the second hollow cavity portion;

an exhale chamber comprising a second front portion, a second body portion, and a second rear portion, wherein the exhale chamber is connected to the inhale chamber through an inter-chamber orifice, wherein the second body portion comprises a first filter element interlocked to a second filter element, and wherein a second valve capable of sealing or unsealing an opening within second hollow tube portion is located within a third hollow cavity portion of the second rear portion and within the second hollow tube portion that connects the third hollow cavity portion to a mouthpiece cavity within the rear housing mouth cover, and wherein a fan element is located within the second front portion; and an ignition element comprising an igniter filament connected to at least one wire, wherein the at least one wire is connected to an electricity source, and wherein a main housing lower tray houses the fan element, wherein the inhale chamber and the exhale chamber are connected to the first filter element and the second filter element and a mouthpiece component, wherein the system is configured to facilitate a flow of first-hand smoke through an inhale pathway from the cigarette holder element within the first hollow cavity portion to the second hollow cavity portion of the inhale chamber based on an occurrence of an inhalation event, wherein the second hollow cavity portion is positioned within the mouthpiece component, wherein the system is configured to facilitate a flow of second-hand smoke to travel through an exhale pathway from the third hollow cavity portion of the inhale chamber through an inter-chamber opening and into a series of filters, wherein the third hollow cavity portion is within the mouthpiece component, wherein the second hollow cavity portion and the third hollow cavity portion are separate chambers within the mouthpiece component;

wherein the system is configured to facilitate a flow of sidestream smoke that emanates from a burning cigarette and travels through an inter-chamber pathway from the first hollow cavity portion, through an inter-chamber orifice, through the first filter element comprising a high efficiency particulate air (HEPA) filter, through the second filter element comprising a carbon-based filter, through the fan element and into an exit vent opening of the exhale chamber, wherein the inter-chamber orifice is connected to the first filter element and the first hollow cavity portion, wherein the inter-chamber orifice forces a one-way movement of the flow of sidestream smoke based on a configuration of the inter-chamber orifice that includes an exit opening narrower than an entrance opening, and wherein the first filter is configured to interlock with the second filter.

2. The system of claim 1, further comprising a main housing portion comprising the main housing lower tray, a main housing front cover, a main housing front baffle, a main housing igniter door, and a main housing electronics cover, wherein the main housing front cover is configured to encase the fan element and connects with the main housing lower tray, wherein the main housing front baffle is configured to connect to the main housing front cover and a smoke tube of the inhale chamber, wherein the main housing igniter door is connected to the main housing front baffle, wherein the main housing electronics cover is configured to encase a top portion of a set of batteries and a printed circuit board, and wherein the main housing electronics cover is connected to the main housing lower tray.

3. The system of claim 2, further comprising the rear housing mouth cover, a rear housing inner valve seat, and a rear housing click mechanism, wherein the rear housing mouth cover is configured to connect in part with the first valve, the second valve and a bypass grommet capable of cradling a first head portion of the first valve and a second head portion of the second valve, wherein the rear housing inner valve seat is configured to form a seal capable of containing smoke between the bypass grommet, a first filter O ring, a smoke tube O ring, the cigarette holder element, the smoke tube, and the rear housing mouth cover.

4. The system of claim 2, wherein the printed circuit board is configured to facilitate execution of device ignition operations, digital operations, and display operations.

5. The system of claim 1, wherein the cigarette holder element is comprised of a silicone material.

6. The system of claim 1, further comprising a lower housing fan cover configured to lay upon the main housing lower tray in between the fan element and a vent opening of the main housing lower tray.

7. The system of claim 1, further comprising an igniter door filter and an igniter housing body, wherein the igniter door filter is located in between the main housing igniter door and the main housing front cover, and wherein the ignition element is connected to the main housing lower tray.

8. The system of claim 1, further comprising a membrane label cover connected to a side panel of the main housing lower tray, wherein the membrane label is configured as a user interface.

9. The system of claim 1, wherein the first valve and the second valve are mini petal valves configured to open and close based on an applied pressure to a diaphragm portion of the first valve or the second valve to disturb or create a seal respectively.

10. The system of claim 1, wherein the first filter is a HEPA filter, and wherein the second filter is a charcoal filter.

11. The system of claim 1, further comprising a spring element and a pin element connected to the igniter door, and wherein the spring element and the pin element are capable of forming a hinge on the igniter door.

12. A method comprising:

facilitating, by a device comprising an inhale chamber and an exhale chamber connected to a first filter element and a second filter element and a mouthpiece component, a flow of first-hand smoke to travel through an inhale pathway from a cigarette holder element within a first hollow cavity portion to a second hollow cavity portion of the inhale chamber based on an occurrence of an inhalation event, wherein the second hollow cavity portion is positioned within the mouthpiece component of the device;

facilitating, by the device, a flow of second-hand smoke to travel through an exhale pathway from a third hollow cavity portion of the inhale chamber, through an inter-chamber opening and into the series of filters, wherein the third hollow cavity portion is within the mouthpiece component, and wherein the second hollow cavity portion and the third hollow cavity portion are separate chambers within the mouthpiece component; and facilitating, by the device, a flow of sidestream smoke that emanates from a burning cigarette and travels through an inter-chamber pathway from the first hollow cavity portion, through an inter-chamber orifice, through the first filter element comprising a high efficiency particulate air (HEPA) filter, through the second filter element comprising a carbon-based filter, through a fan element and into an exit vent opening of the exhale chamber, wherein the inter-chamber orifice is connected to the first filter element and the first hollow cavity portion, wherein the inter-chamber orifice forces a one-way movement of the flow of sidestream smoke based on a configuration of the inter-chamber orifice that includes an exit opening narrower than an entrance opening, and wherein the first filter is configured to interlock with the second filter.

13. The method of claim 12 comprising, facilitating, by the device, ignition of a cigarette gripped within the cigarette holder element, wherein the cigarette is any one of a range of cigarette sizes, wherein an ignition element of the device is configured to ignite the cigarette, and wherein the ignition element is a stick capable of interfacing with and igniting the cigarette.

14. The method of claim 13, further comprising propelling, by the device, the flow of second-hand smoke or the flow of sidestream smoke toward the vent opening based on applied propulsive force generated by the fan element.

15. The method of claim 12, further comprising simultaneously opening, by the device, a first valve and closing, by the device, a second valve based on an applied first force to the first valve and an applied second force to the second valve to facilitate the flow of first-hand smoke to travel from the cigarette holder element to a second hollow cavity portion, wherein the cigarette can be a hand-rolled cigarette or a manufactured cigarette.

16. The method of claim 15, further comprising simultaneously closing, by the device, the first valve and the second valve based on an absence of pressure applied to the first valve and the second valve to inhibit the flow of first-hand smoke and the flow of second-hand smoke from occurring.

17. The method of claim 12, further comprising simultaneously opening, by the device, a second valve and closing, by the device, a first valve based on an applied third pressure to the second valve and an applied fourth pressure to the first valve to facilitate the flow of second-hand smoke from a fifth hollow cavity through the second hollow tube portion, through the first filter element, through the second filter element, through the fan element and into the exit vent opening of the exhale chamber, wherein the carbon-based filter comprises an activated carbon configured to absorb gases and chemicals from smoke streams within carbon pores of the activated carbon.

18. A device comprising:

an inhale chamber and an exhale chamber connected to a first filter element and a second filter element and a mouthpiece component, wherein, the inhale chamber is configured to facilitate a flow of first-hand smoke to travel through an inhale pathway from a cigarette holder element within a first hollow cavity portion to a second hollow cavity portion of the inhale chamber based on an occurrence of an inhalation event, wherein the second hollow cavity portion is positioned within the mouthpiece component of the device;

wherein the exhale chamber is configured to facilitate a flow of second-hand smoke to travel through an exhale pathway from a third hollow cavity portion of the inhale chamber, through an inter-chamber opening and into the series of filters, wherein the third hollow cavity portion is within the mouthpiece component, and wherein the second hollow cavity portion and the third hollow cavity portion are separate chambers within the mouthpiece component; and wherein the device is configured to facilitate a flow of sidestream smoke that emanates from a burning cigarette and travels through an inter-chamber pathway from the first hollow cavity portion, through an inter-chamber orifice, through the first filter element comprising a high efficiency particulate air (HEPA) filter, through the second filter element comprising a carbon-based filter, through a fan element and into an exit vent opening of the exhale chamber, wherein the inter-chamber orifice is connected to the first filter element and the first hollow cavity portion, wherein the inter-chamber orifice forces a one-way movement of the flow of sidestream smoke based on a configuration of the inter-chamber orifice that includes an exit opening narrower than an entrance opening, and wherein the first filter is configured to interlock with the second filter.

19. The device of claim 14, further comprising a first valve that facilitates the flow of first-hand of first smoke to travel from the cigarette holder element to a second hollow cavity portion based on the first valve being open or prevents the travel of the first flow of first smoke based on the first valve being closed.

* * * * *